US012559943B2

(12) United States Patent
Woods et al.

(10) Patent No.: US 12,559,943 B2
(45) Date of Patent: Feb. 24, 2026

(54) REINFORCING STEEL SKELETAL FRAMEWORK

(71) Applicant: Midland Steel Reinforcement Supplies Limited, Mountmellick (IE)

(72) Inventors: Martin Anthony Woods, Coolbanagher Emo (IE); Paul Robert Woods, Coolbanagher Emo (IE)

(73) Assignee: Midland Steel Reinforcement Supplies Ltd., Mountmellick (IE)

( * ) Notice: Subject to any disclaimer, the term of this patent is extended or adjusted under 35 U.S.C. 154(b) by 900 days.

(21) Appl. No.: 17/762,552

(22) PCT Filed: Sep. 23, 2020

(86) PCT No.: PCT/EP2020/076621
§ 371 (c)(1),
(2) Date: Mar. 22, 2022

(87) PCT Pub. No.: WO2021/058600
PCT Pub. Date: Apr. 1, 2021

(65) Prior Publication Data

US 2022/0356706 A1 Nov. 10, 2022

(30) Foreign Application Priority Data

Sep. 23, 2019 (GB) ..... 1913674
Feb. 25, 2020 (GB) ..... 2002644

(51) Int. Cl.
*E04C 5/06* (2006.01)
*E04C 5/20* (2006.01)

(52) U.S. Cl.
CPC ..... *E04C 5/0631* (2013.01); *E04C 5/064* (2013.01); *E04C 5/205* (2013.01)

(58) Field of Classification Search
CPC ..... E04C 5/166; E04C 5/064; E04C 5/0609; E04C 5/0625; E04C 5/0631; E04C 5/0636; E04C 5/0627; E04C 5/04
See application file for complete search history.

(56) References Cited

U.S. PATENT DOCUMENTS 4,185,423 A 1/1980 Gutierrez
5,218,809 A 6/1993 Baumann
(Continued)

FOREIGN PATENT DOCUMENTS

DE 202005018617 U1 3/2006
EP 0143101 A2 8/1984
(Continued)

OTHER PUBLICATIONS

Search Report for GB1913674.6, Feb. 24, 2020, 1 page.
International Search Report and Written Opinion for PCT/EP2020/076621, Jan. 19, 2021, 11 pages.

*Primary Examiner* — Jessica L Laux
(74) *Attorney, Agent, or Firm* — LaBatt, LLC

(57) ABSTRACT

A number of modular preformed skeletal steel panels are mounted side by side in a row on a building structure to form a composite panel assembly on the building structure. Each modular preformed skeletal steel panel comprises two mesh layers, namely a bottom mesh layer and a top mesh layer supported spaced-apart in parallel planes by intermediate spacers extending between the layers. The bottom layer has a plurality of spaced-apart outwardly projecting splice bars for interengagement with an adjacent preformed skeletal steel panel in the panel assembly thus facilitating interengagement of the modular preformed skeletal steel panels in the composite panel assembly. Each spacer comprises a cross member engaged with the top layer and having outwardly extending legs at opposite ends of the cross member. A lower end of each leg terminates in a foot which engages
(Continued)

with the bottom layer. The cross member, legs and feet are all mutually perpendicular.

13 Claims, 29 Drawing Sheets

(56) References Cited

U.S. PATENT DOCUMENTS

| | | | | |
|---|---|---|---|---|
| 2009/0235601 | A1 | 9/2009 | Mellett | |
| 2013/0047545 | A1* | 2/2013 | Standal | E04C 5/04 52/649.1 |
| 2016/0108618 | A1* | 4/2016 | Buzimkic | E04C 2/06 52/649.1 |

FOREIGN PATENT DOCUMENTS

| | | | |
|---|---|---|---|
| FR | 3017140 | A1 | 8/2015 |
| WO | 2018083272 | A1 | 5/2018 |

* cited by examiner

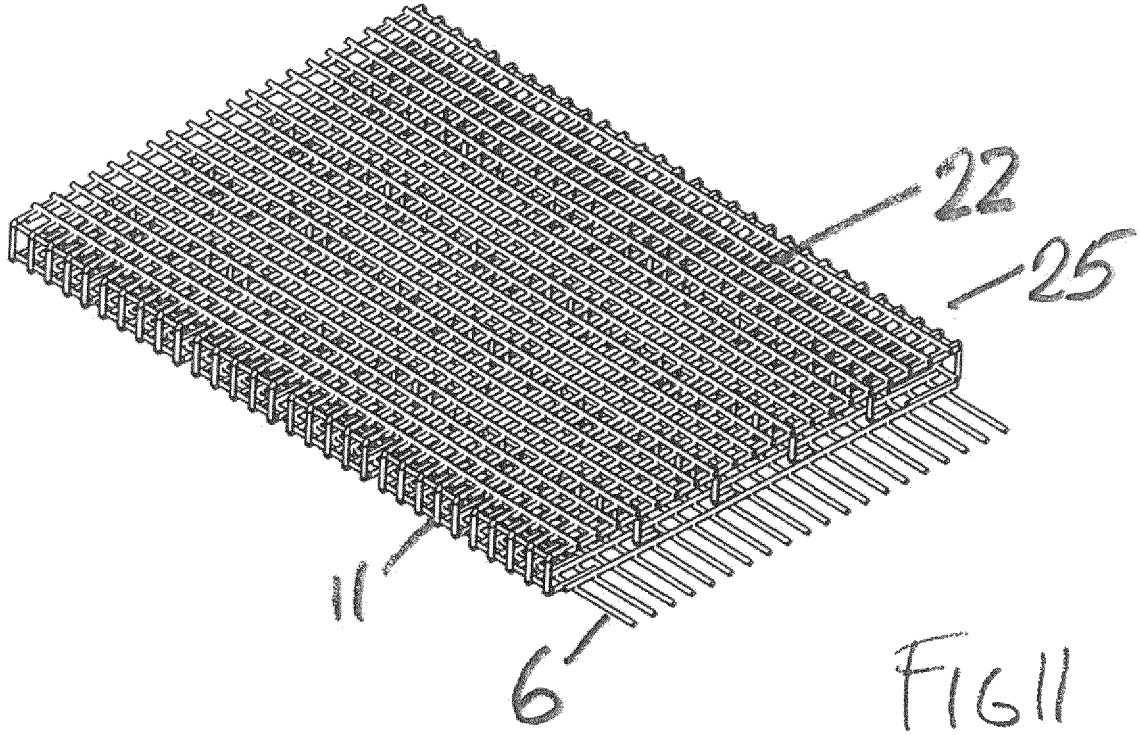
FIG 11
FIG 12
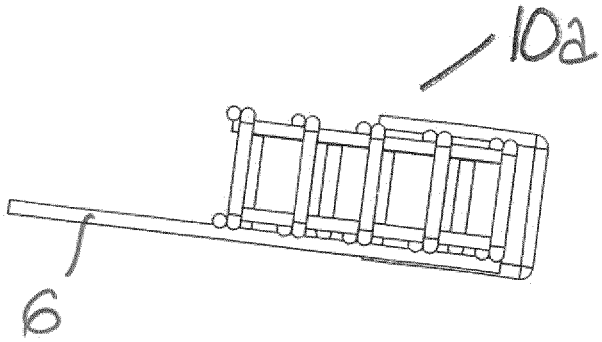

REINFORCING STEEL SKELETAL FRAMEWORK

INTRODUCTION

This invention relates to reinforcing steel skeletal frameworks, in particular for use in the construction of reinforced concrete structures.

BACKGROUND TO THE INVENTION

Reinforced concrete is used to build many different types of structures and components of structures including slabs, walls, floors, beams, columns, foundations, frames and civil engineering projects including but not limited to bridge decks, water treatment plants and airport runways, for example. Generally speaking, reinforcing steel bars are assembled into a framework on the building structure and then concrete is poured around the framework to form a floor or wall, for example. Constructing the steel framework on site is relatively time consuming and generally skilled steel workers are required. There is also a safety issue with workers moving about the steel framework as it is being constructed.

To address these problems, we have previously proposed a prefabricated reinforcing framework which can be constructed on site or more preferably constructed off site and transported to the building site, and then simply lifted into position on the building structure. This is described in WO 2018/083272.

The present invention is directed towards further improvements in this type of reinforcing steel skeletal framework.

EP 0 143 101 A2 discloses a reinforcement for reinforced concrete constructions comprising reinforcement elements in the form of U-brackets interconnected by rods. US 2009/235601 A1 discloses a method for manufacturing a wall unit comprising arranging a plurality of I-section wall ties spaced apart in an upright orientation and engaging a reinforcing mesh within recessed slots in the wall ties. FR 3 017 140 A1 discloses a device for shuttering walls.

SUMMARY OF THE INVENTION

According to the invention, there is provided a method for forming a composite reinforcing steel skeletal framework on a building structure, including:

- placing a plurality of modular preformed skeletal steel panels side-by-side in a row on the building structure to form a panel assembly on the building structure, and
- covering an outer face of the panel assembly with an outer steel mesh mat to form the composite reinforcing steel skeletal framework.

In another embodiment, the method includes mounting an inner steel mesh mat on the building structure and placing the skeletal steel panels on or against the inner steel mesh mat.

In another embodiment, each preformed skeletal steel panel has a plurality of spaced-apart outwardly projecting splice bars for interengaging with an adjacent preformed skeletal steel panel in the panel assembly for interlocking the preformed skeletal steel panels in the panel assembly.

In another embodiment, the splice bars are located at an inner side of the preformed skeletal steel panel and the method includes mounting the outer steel mesh mat across outer sides of the preformed skeletal steel panels in the panel assembly at an opposite side to the splice bars.

In another embodiment, the method includes feeding tensioning strands through each preformed skeletal steel panel.

In another embodiment, each steel mesh mat comprises a roll-out mat and the method includes rolling out the steel mesh mat across the panel assembly or across the building structure.

In another embodiment, the method includes arranging the panel assembly in a horizontal orientation on the building structure for forming a floor on the building structure.

In another embodiment, the method includes arranging the panel assembly in an upright orientation on the building structure for forming a wall on the building structure.

In another embodiment, each preformed skeletal steel panel comprises at least two mesh layers supported spaced-apart in parallel planes by intermediate spacers extending between the layers.

In another embodiment, each preformed skeletal steel panel has an adjustable side edge.

In another embodiment, the adjustable side edge is slidably adjustable on the preformed skeletal steel panel.

In another embodiment, the adjustable side edge comprises a U-frame having an outer end with a number of pairs of inwardly extending spaced-apart parallel arms which slidably engage with a main body of the preformed skeletal steel panel.

In another embodiment, each spacer comprises a cross member engaged with a first one of the layers, the cross member having outwardly extending legs at opposite ends of the cross member, each leg terminating in a foot which engages with a second one of the layers, the cross member, legs and feet being mutually perpendicular.

In another embodiment, the cross member is bent inwardly in the direction of the legs intermediate its ends.

In another embodiment, the cross member is V-shaped.

In another embodiment, the cross member is arcuate.

In another embodiment, the spacers comprise rectangular spacer elements.

In another embodiment, the spacers comprise V-shaped spacer elements.

In another aspect of the invention, there is provided a composite reinforcing steel skeletal framework comprising a plurality of modular preformed skeletal steel panels mounted side by side in a row to form a composite panel assembly, each preformed skeletal steel panel having a number of spaced-apart outwardly projecting splice bars engaged with an adjacent preformed skeletal steel panel, and an outer steel mesh mat mounted across an outer face of the panel assembly.

In another embodiment the outer steel mesh mat is mounted across the outer face of the panel assembly at an opposite side to the splice bars.

In another embodiment, each preformed skeletal steel panel comprises at least two mesh layers supported spaced-apart in parallel planes by intermediate spacers extending between the layers.

In another embodiment, each preformed skeletal steel panel has an adjustable side edge.

In another embodiment, the adjustable side edge is slidably adjustable on the preformed skeletal steel panel.

In another embodiment, the adjustable side edge comprises a U-frame having an outer end with a number of pairs of inwardly extending spaced-apart parallel arms which slidably engage with a main body of the preformed skeletal steel panel.

In another embodiment, each spacer comprises a cross member engaged with a first one of the layers, the cross member having outwardly extending legs at opposite sides of the cross member, each leg terminating in a foot which engages with a second one of the layers, the cross member, legs and feet being mutually perpendicular.

In another embodiment, the cross member is bent inwardly in the direction of the legs intermediate its ends.

BRIEF DESCRIPTION OF THE DRAWINGS

The invention be more clearly understood by the following description of some embodiments thereof, given by way of example only, with reference to the accompanying drawings, in which:

FIG. 11 is a perspective view of the composite reinforcing steel skeletal framework shown in FIG. 9;

FIG. 12-FIG. 17 show a sequence of assembly of a number of the modular preformed skeletal steel panels to form the composite reinforcing steel skeletal framework of the invention;

DESCRIPTION OF THE PREFERRED EMBODIMENTS

Figure 1:
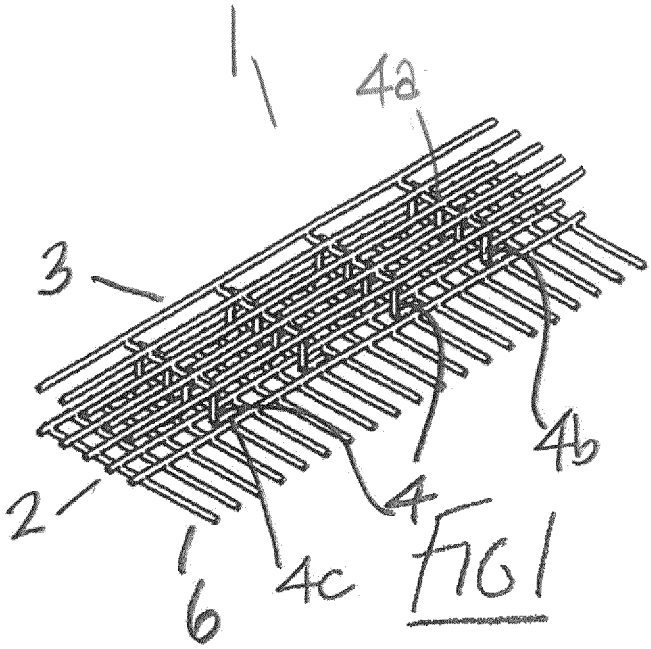
FIG. 1 is a perspective view of a modular preformed skeletal steel panel for use in the method of the invention.
Figure 2:
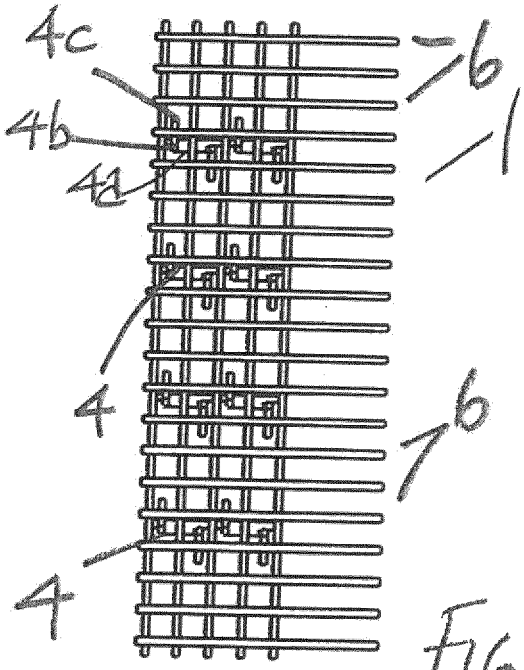
FIG. 2 is a plan view of the modular preformed skeletal steel panel.
Figure 3:
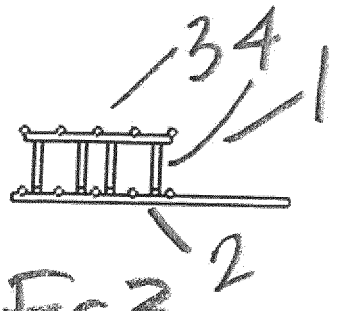
FIG. 3 is a side elevational view of the modular preformed skeletal steel panel.

Referring to the drawings, a method according to the invention for forming a composite reinforcing steel skeletal framework on a building structure will be described.

Figure 4:
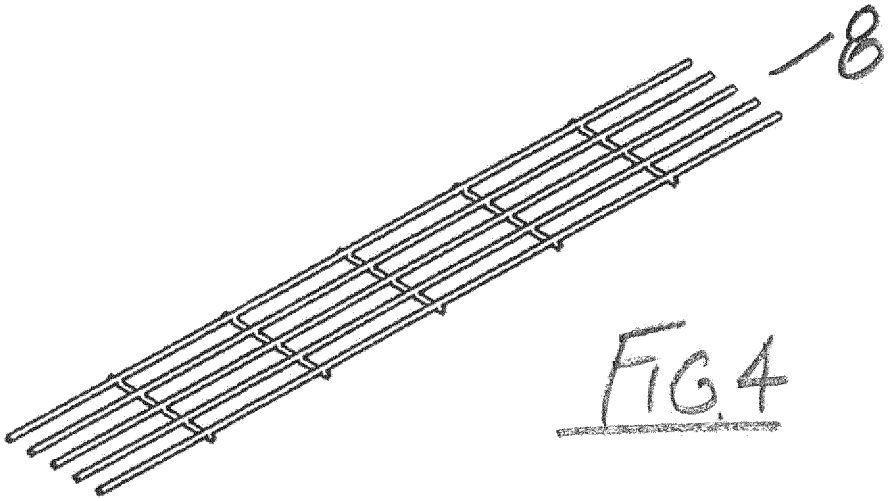
FIG. 4 is a perspective view of a steel mesh mat used in the method of the invention.
Figure 5:
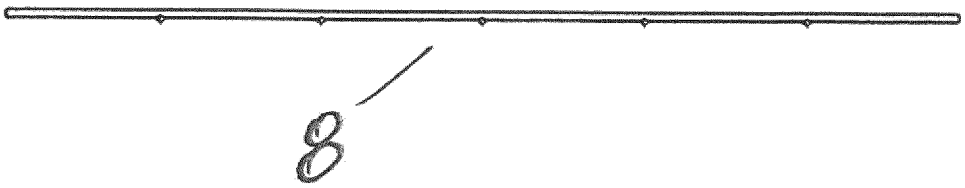
FIG. 5 is an elevational view of the steel mesh mat shown in FIG. 4.
Figure 6:
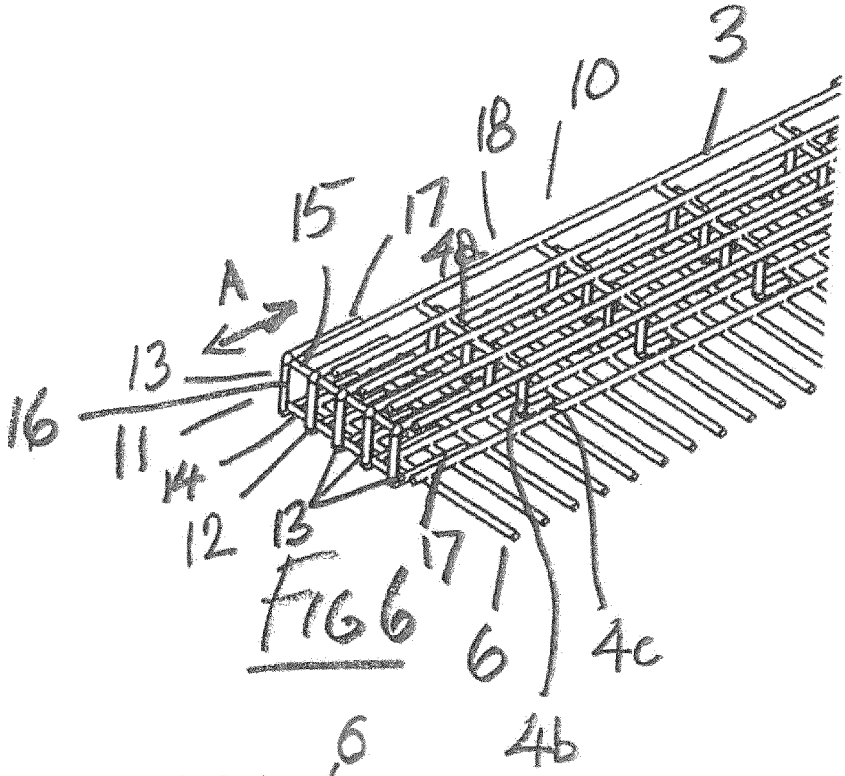
FIG. 6 is a perspective view of another modular preformed skeletal steel panel for use in the method of the invention.
Figure 7:
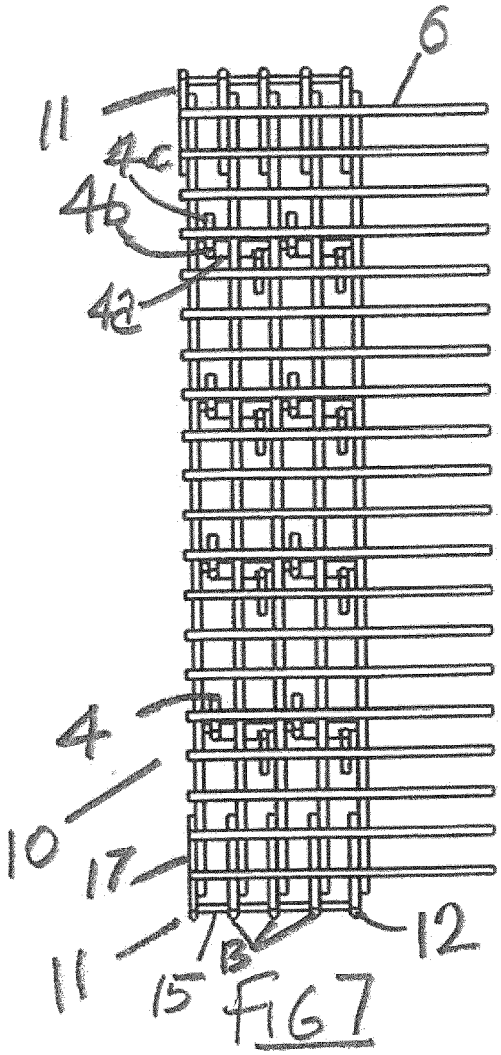
FIG. 7 is a plan view of the modular preformed skeletal steel panel shown in FIG. 6.

Referring initially to FIGS. 1 to 5 of the drawings, there is shown a modular preformed skeletal steel panel indicated generally by the reference numeral 1. The modular preformed skeletal steel panel 1 comprises two mesh layers, namely a bottom mesh layer 2 and a top mesh layer 3 supported spaced-apart in parallel planes by intermediate spacers 4 extending between the layers 2, 3. The bottom layer 2 has a plurality of spaced-apart outwardly projecting splice bars 6 for interengagement with an adjacent preformed skeletal steel panel 1 in a panel assembly as will be later described. FIG. 4 and FIG. 5 show a steel mesh mat 8 for cooperation with the preformed skeletal steel panels 1 to form a composite reinforcing steel skeletal framework of the invention as will be later described.

Each spacer 4 comprises a cross member 4*a* engaged with the top layer 3 and having outwardly extending legs 4*b* at opposite ends of the cross member 4*a*. A lower end of each leg 4*b* terminates in a foot 4*c* which engages with the bottom layer 2. The cross member 4*a*, legs 4*b* and feet 4*c* are all mutually perpendicular.

Referring now to FIGS. 6 to 17, another modular preformed skeletal steel panel according to the invention and indicated generally by the reference numeral 10 is shown. This is largely similar to the modular preformed skeletal steel panel 1 described previously and like parts are assigned the same reference numerals. In this case the modular preformed skeletal steel panel 10 has an adjustable side edge 11. The adjustable side edge 11 comprises a U-frame 12 having a number of spaced-apart U-shaped elements 13 mounted spaced-apart on cross members 14, 15. Each frame element 13 has an outer end 16 with a pair of inwardly extending spaced-apart parallel arms 17 which slidably engage with a main body 18 of the skeletal steel panel 10, being movable in the direction of arrow A. A U-frame 12 can be provided at one or both sides of the panel 10 as required to provide length adjustment of the panel 10.

Figure 8A:
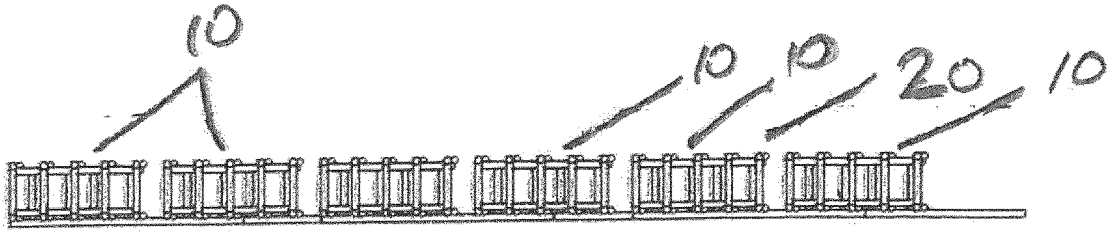
FIG. 8 has elevational and plan views showing assembly of a number of the modular preformed skeletal steel panels shown in FIG. 6 to form a composite panel assembly and then a composite reinforcing steel skeletal framework of the invention.
Figure 8B:
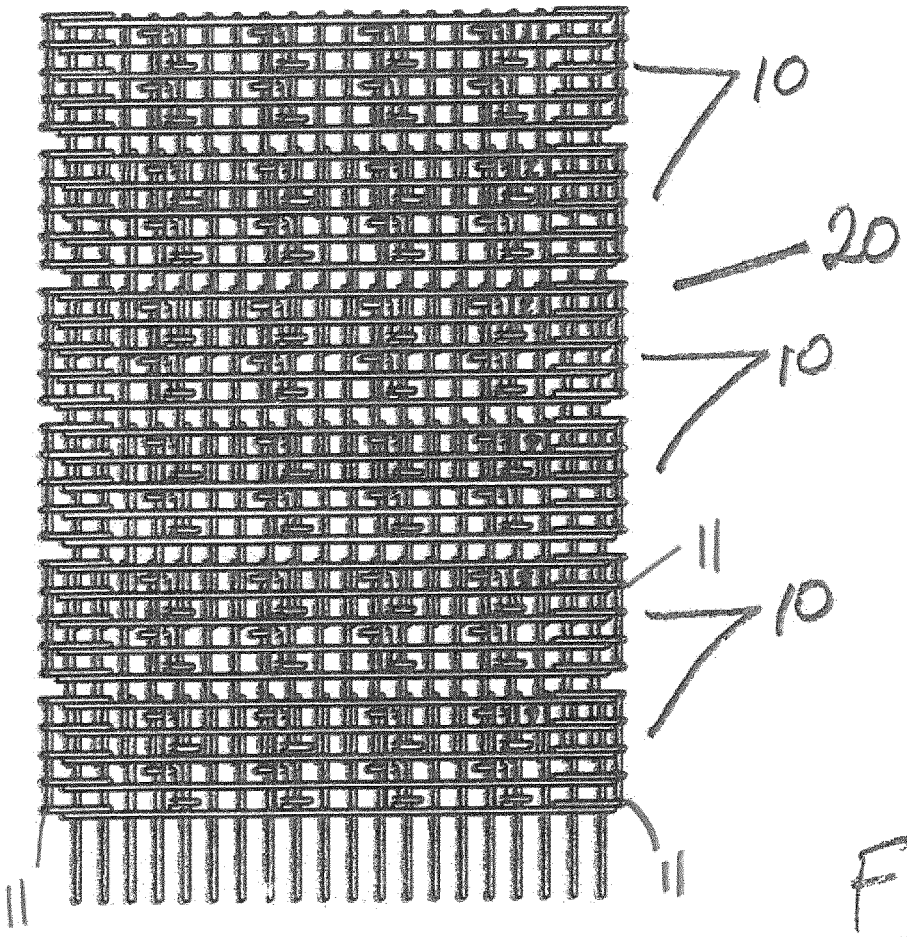
Figure 8C:
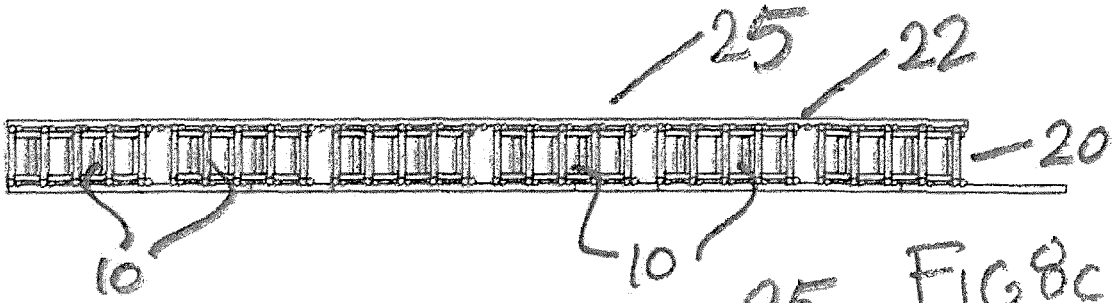
Figure 8D:
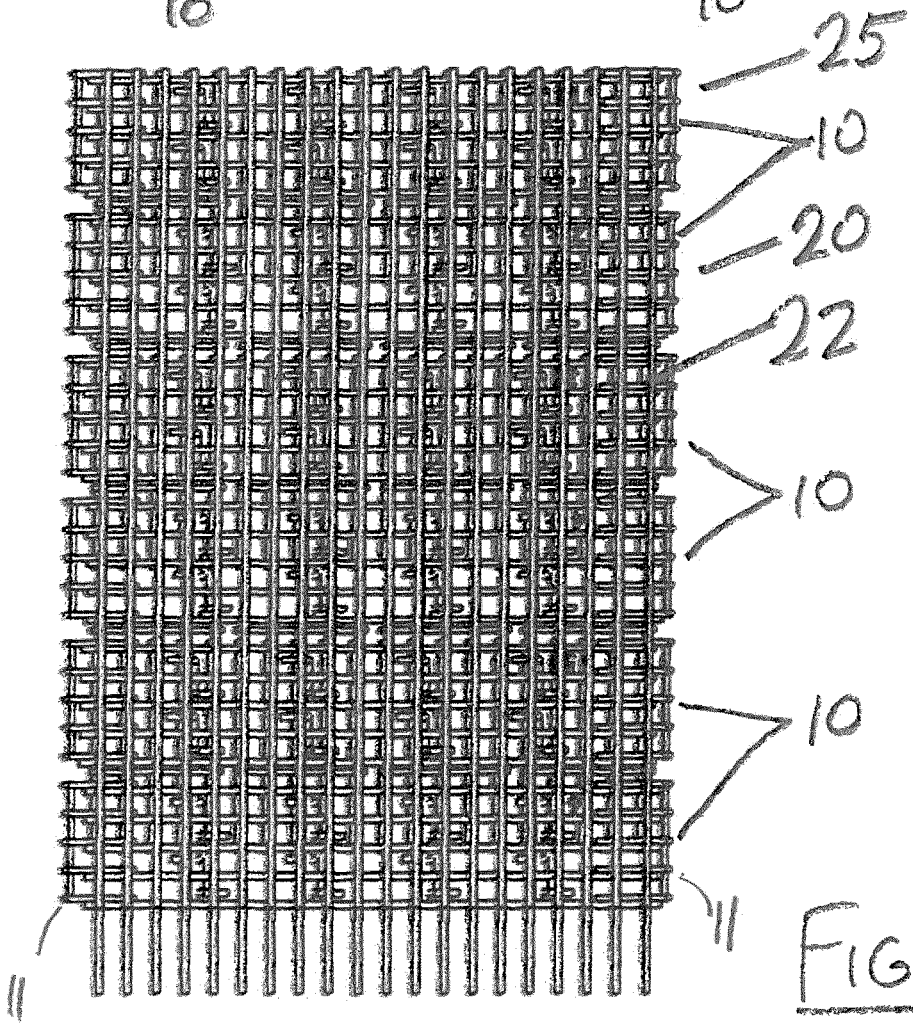
Figure 9:
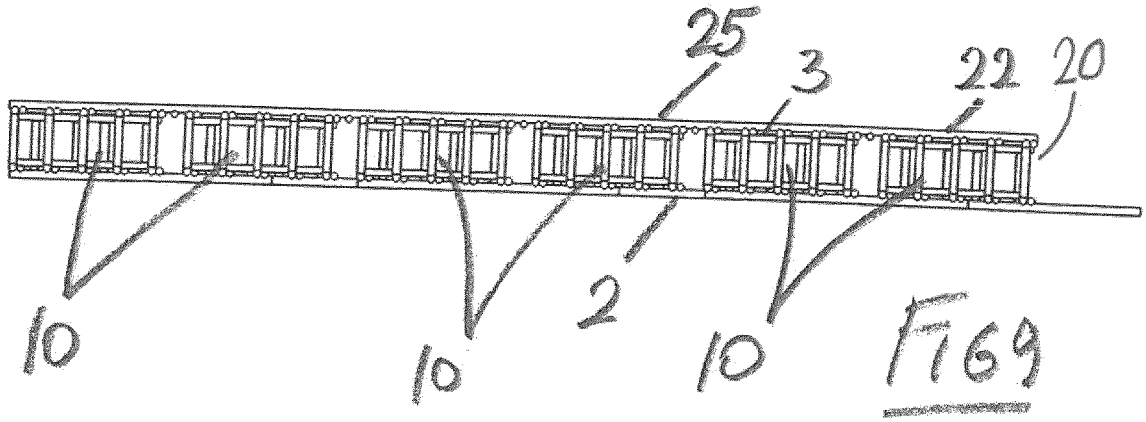
FIG. 9 is an elevational view of a composite reinforcing steel skeletal framework according to the invention formed using the modular preformed skeletal steel panels of FIG. 6.

In accordance with the method of the invention a plurality of the modular preformed skeletal steel panels 10 are placed side-by-side in a row on the building structure as shown in FIG. 8*a* and FIG. 8*b* to form a panel assembly 20. Then a top or outer face of the panel assembly 20 is covered by an outer steel mesh mat 22 (FIG. 8*c*) to form a composite reinforcing steel skeletal framework 25 according to the invention on the building structure, as shown in FIG. 8*c* and FIG. 8*d*.

Figure 10:
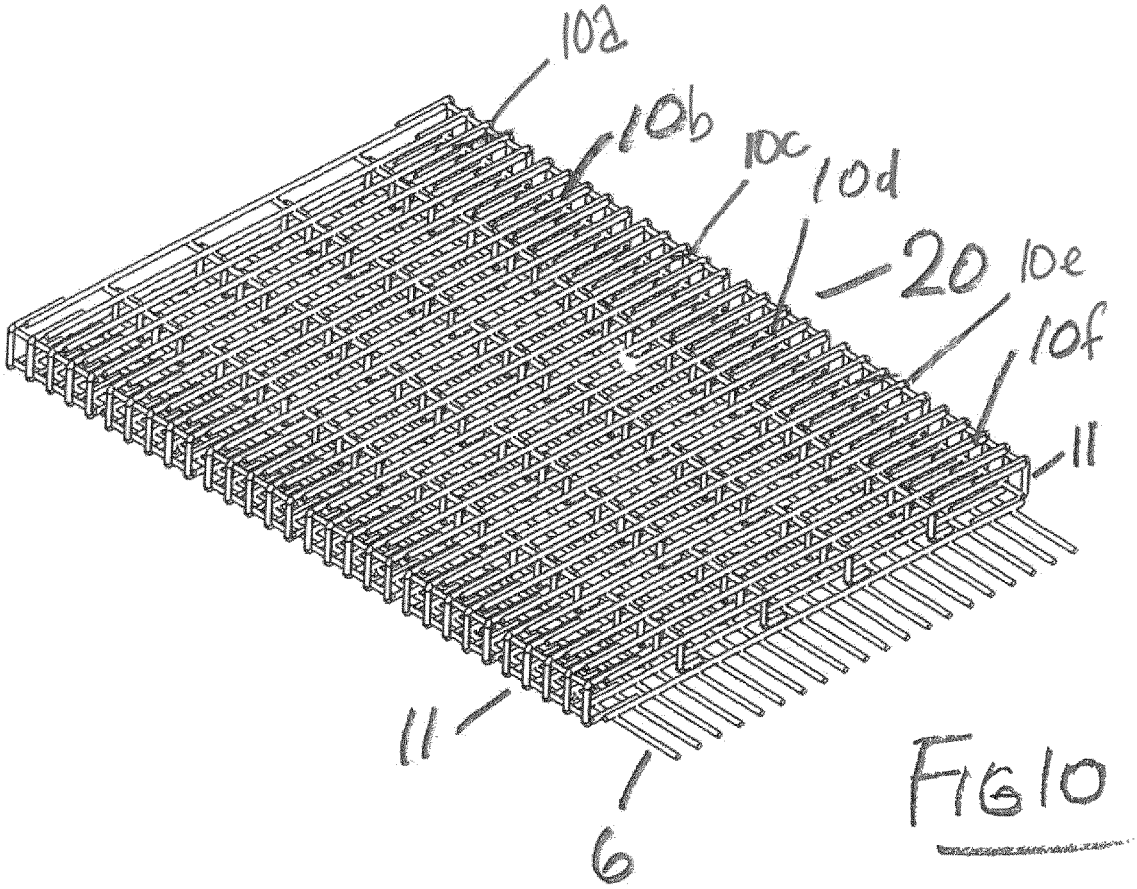
FIG. 10 is a perspective view showing assembly of a number of the modular preformed skeletal steel panels of FIG. 6 to form a panel assembly.
Figure 13:
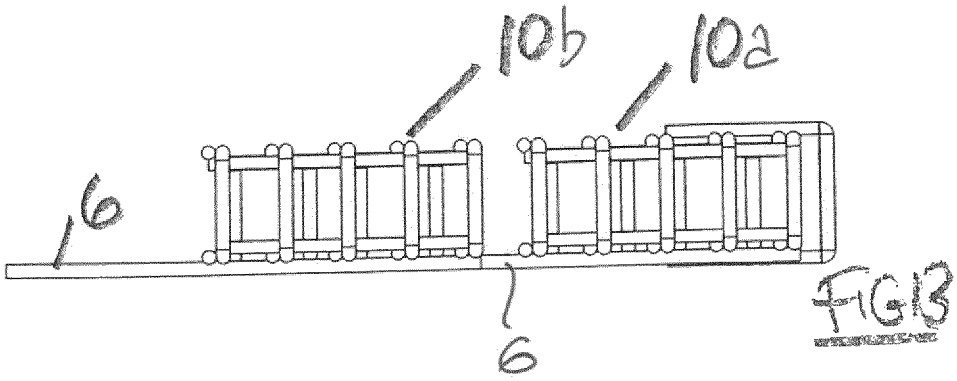
Figure 14:
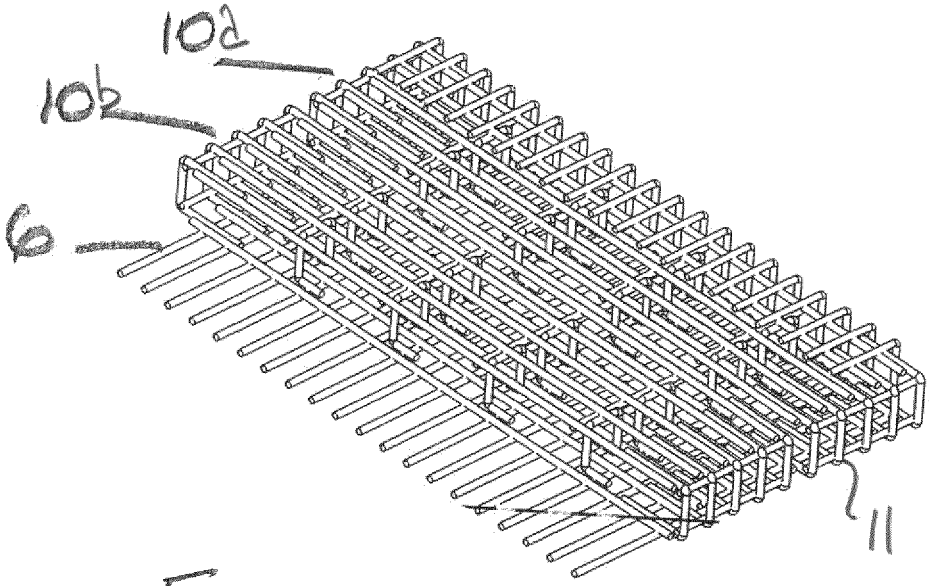
Figure 15:
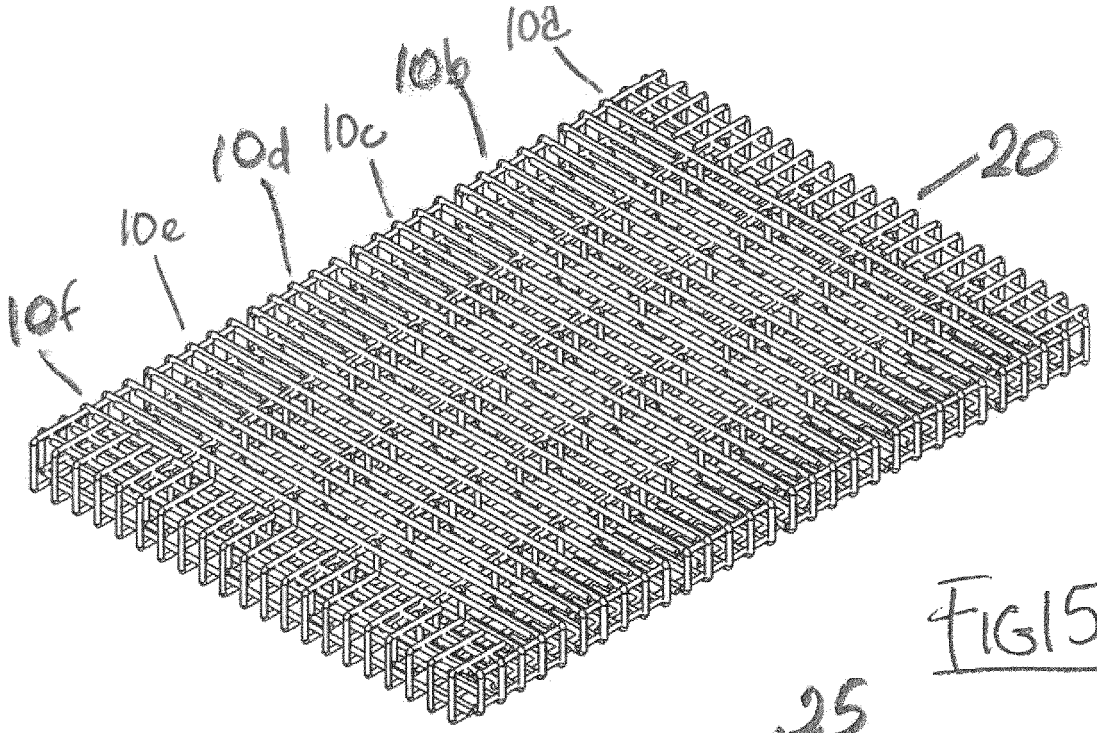
Figure 16:
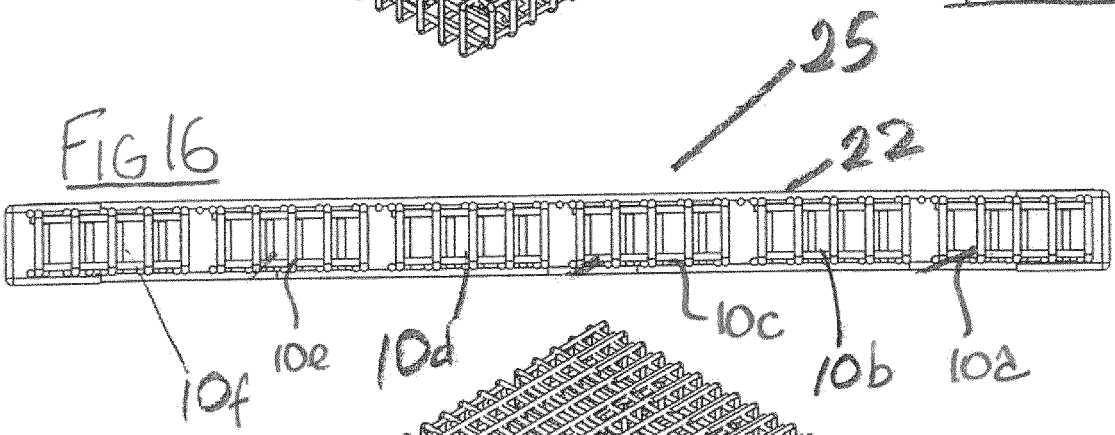
Figure 17:
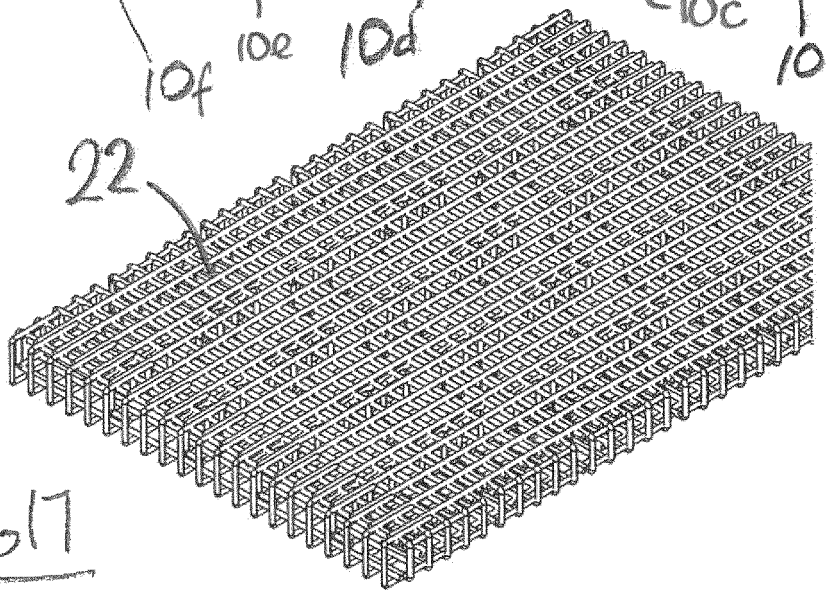

FIG. 12 shows the placement of a first modular preformed skeletal steel panel 10*a* and then FIG. 13 and FIG. 14 show the placement of a second modular preformed skeletal steel panel 10*b* in cooperation with the first modular preformed skeletal steel panel 10*a* with the splice bars 6 of the first modular preformed skeletal steel panel 10*a* interengaging with the second modular preformed skeletal steel panel 10*b*. Additional modular preformed skeletal steel panels 10*c*-10*f* (FIG. 15) are placed in sequence to form a row of preformed skeletal steel panels 10*a*-10*f* on the building structure and thus form a composite panel assembly 20 comprising a plurality of juxtaposed interengaged preformed skeletal steel panels 10*a*-10*f* as shown in FIG. 10 and FIG. 15. The panel assembly 20 is then covered with a top layer of mesh panels forming the steel mesh mat 22 or a roll-out steel mesh mat 22, shown in FIG. 8*c*, FIG. 16 and FIG. 17.

Figures 18, 19:
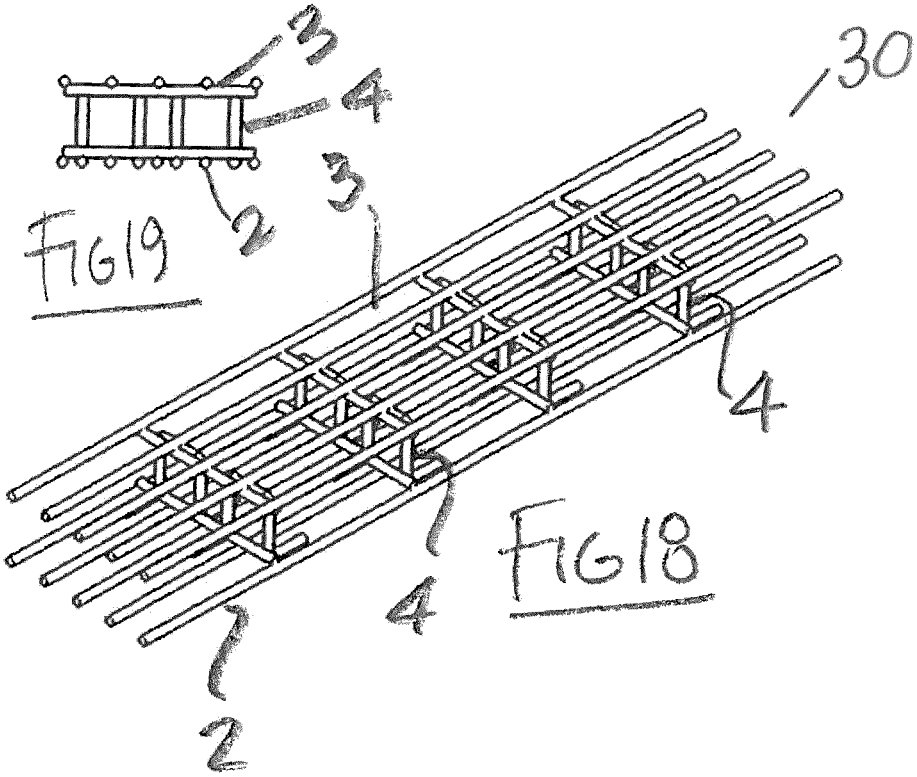
FIG. 18 is a perspective view of another modular preformed skeletal steel panel for use in the method of the invention.
FIG. 19 is a side elevational view of the modular preformed skeletal steel panel shown in FIG. 18.

Referring now to FIG. 18 and FIG. 19, there is shown another modular preformed skeletal steel panel 30. Parts similar to those described previously are assigned the same reference numerals. In this case no splice bars 6 are provided. In forming a composite reinforcing steel skeletal framework according to the method of the invention, a bottom or inner steel mesh mat is placed on the building structure. Then a plurality of the modular preformed skeletal steel panels 30 are mounted side-by-side in a row as previously described on the bottom steel mesh mat. Finally, a top or outer steel mesh mat is mounted over a top of the panel assembly formed by the juxtaposed preformed skeletal steel panels 30.

Figure 20:
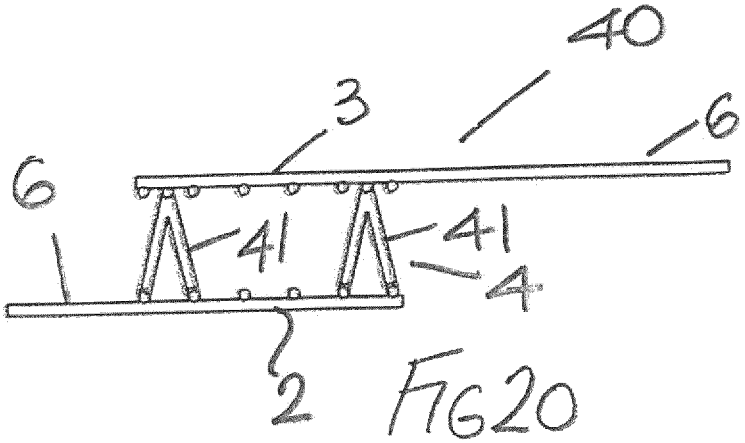
FIG. 20 is a side elevational view of another modular preformed skeletal steel panel for use in the method of the invention.
Figure 21:
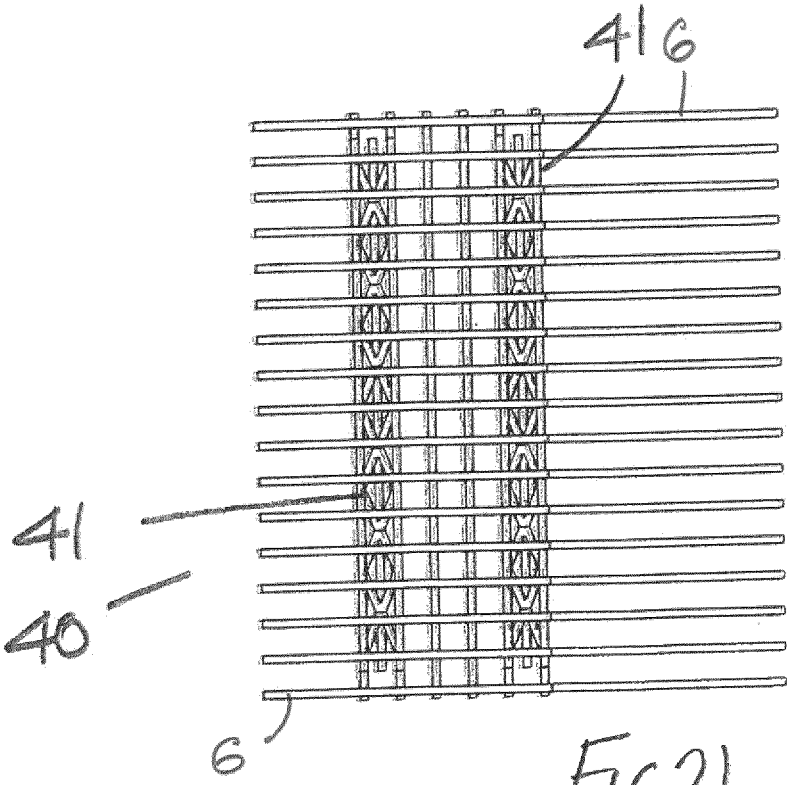
FIG. 21 is a plan view of the modular preformed skeletal steel panel shown in FIG. 20.
Figure 22:
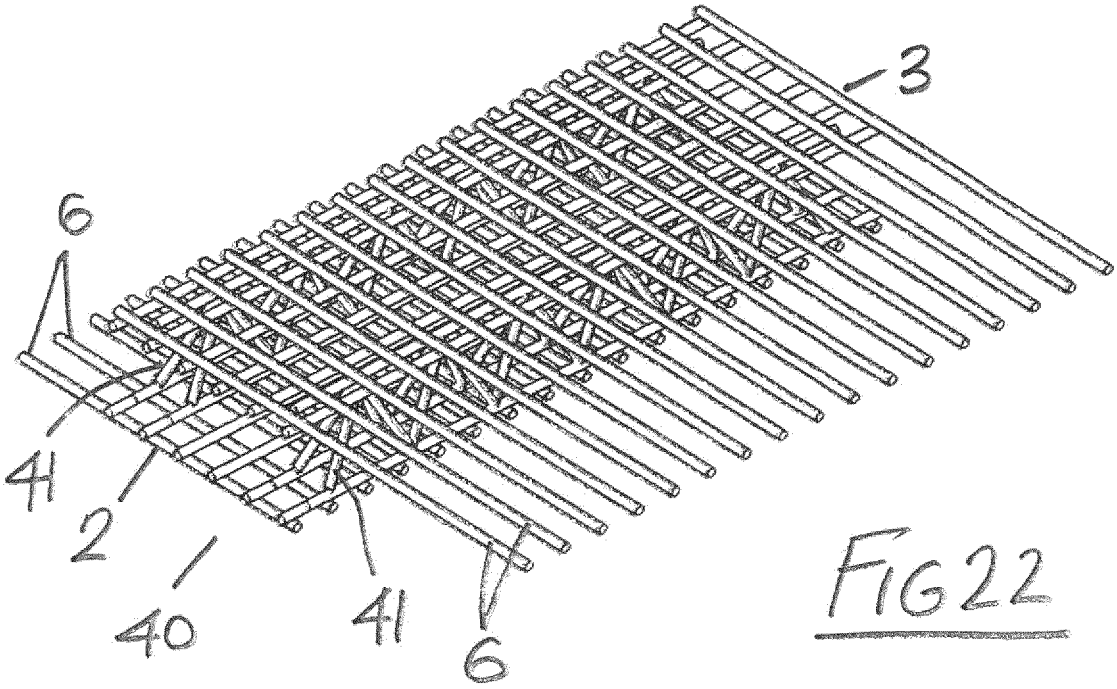
FIG. 22 is a perspective view of the modular preformed skeletal steel panel shown in FIG. 20.

Referring now to FIGS. 20 to 22, there is shown another modular preformed skeletal steel panel, indicated generally by the reference numeral 40 for use in the method of the invention. In this case V-shaped spacer elements 41 are mounted between the two layers 2, 3. Also, each layer 2, 3 has outwardly projecting splice bars 6 which project outwardly at opposite sides of the panel 40.

Figure 23:
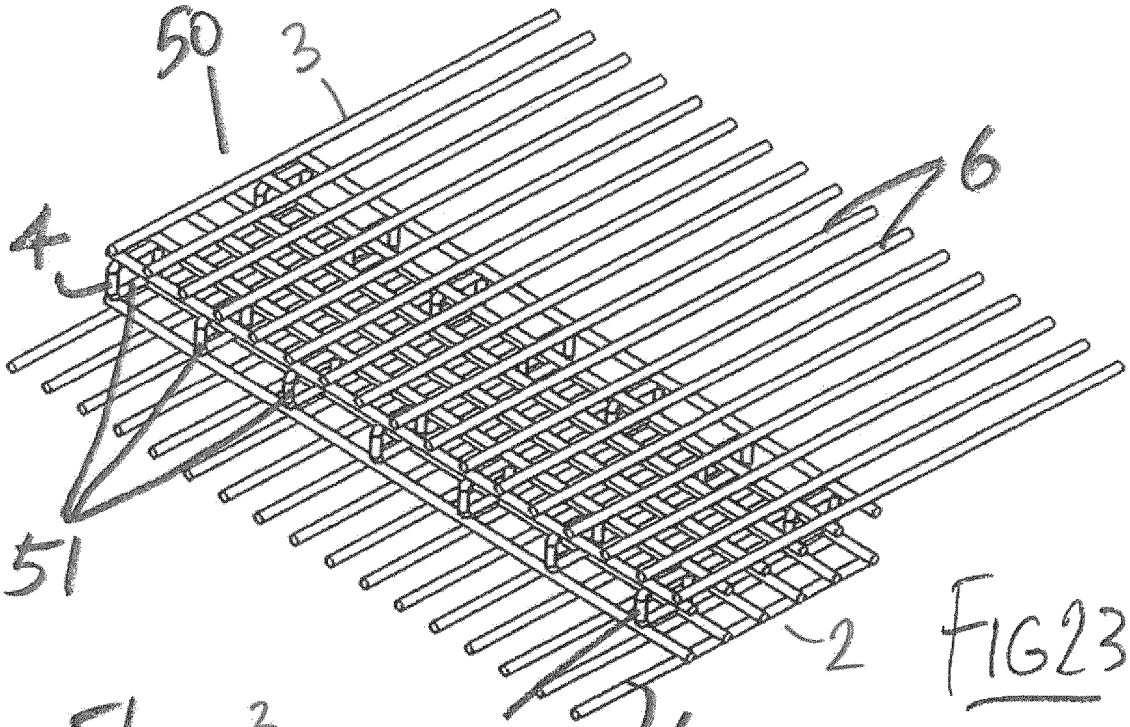
FIG. 23 is a perspective view of another modular preformed skeletal steel panel.
Figure 24:
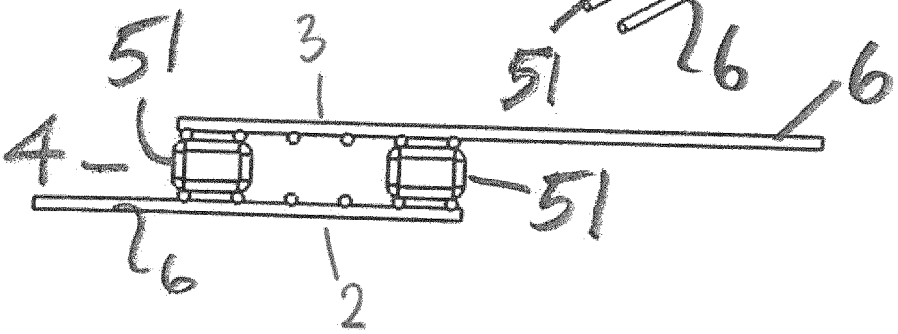
FIG. 24 is a side elevational view of the modular preformed skeletal steel panel shown in FIG. 23.

Referring now to FIG. 23 and FIG. 24, there is shown another modular preformed skeletal steel panel according to the invention indicated generally by the reference numeral 50 for use in the method of the invention. Parts similar to those described previously are assigned the same reference numerals. In this case, the spacers 4 comprise rectangular spacer elements 51.

Figure 26:
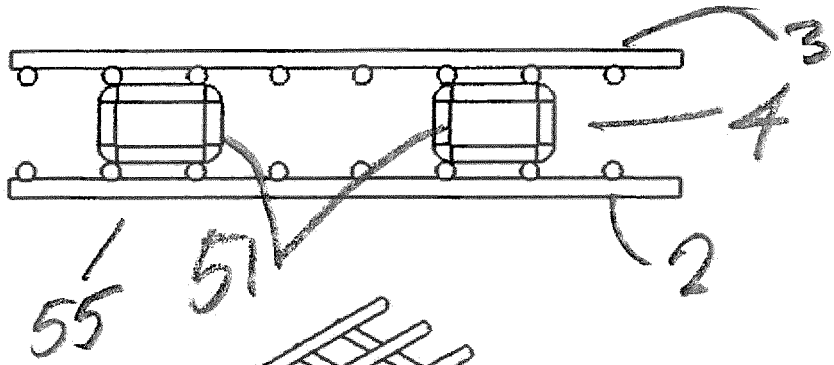
FIG. 26 is a side elevational view of the modular preformed skeletal steel panel shown in FIG. 25.
Figure 25:
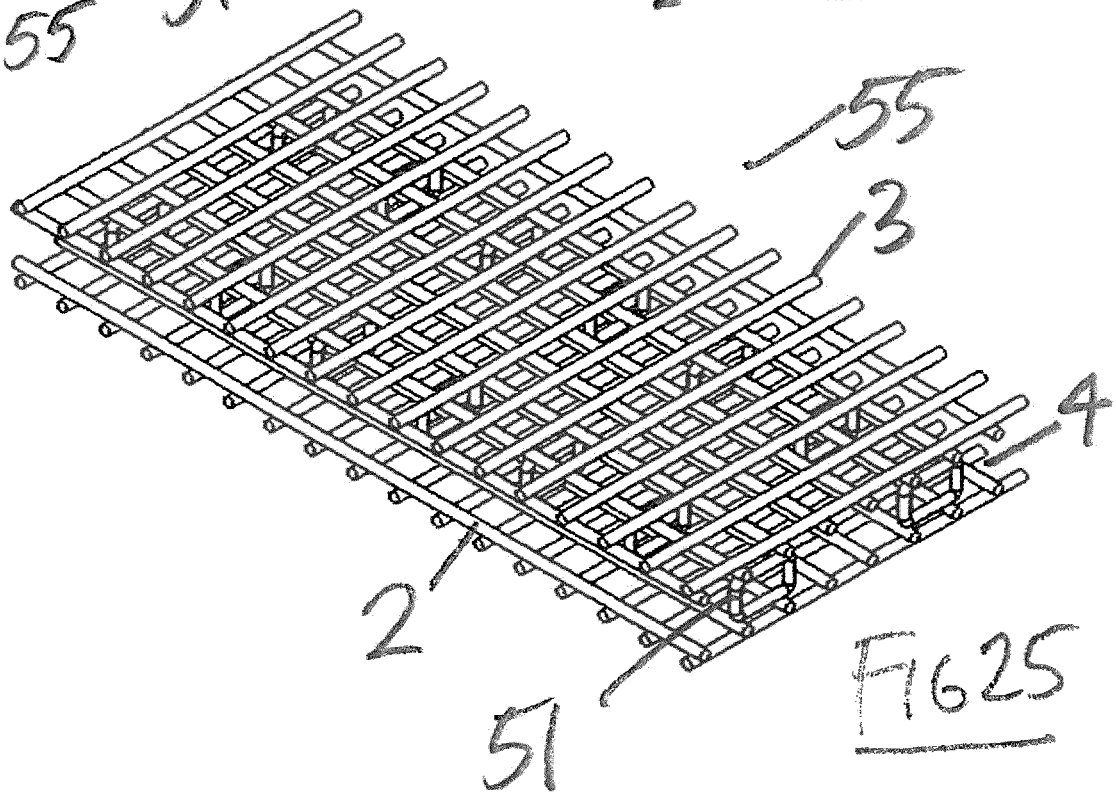
FIG. 25 is a perspective view of a further modular preformed skeletal steel panel.

Referring in particular to FIG. 25 and FIG. 26, there is shown another modular preformed skeletal steel panel 55 for use in the method of the invention. Parts similar to those described previously are assigned the same reference numerals. This is largely similar to the preformed skeletal steel panel 50 described previously. However, in this case no splice bars 6 are provided on the preformed skeletal steel panels 55.

Figure 27:
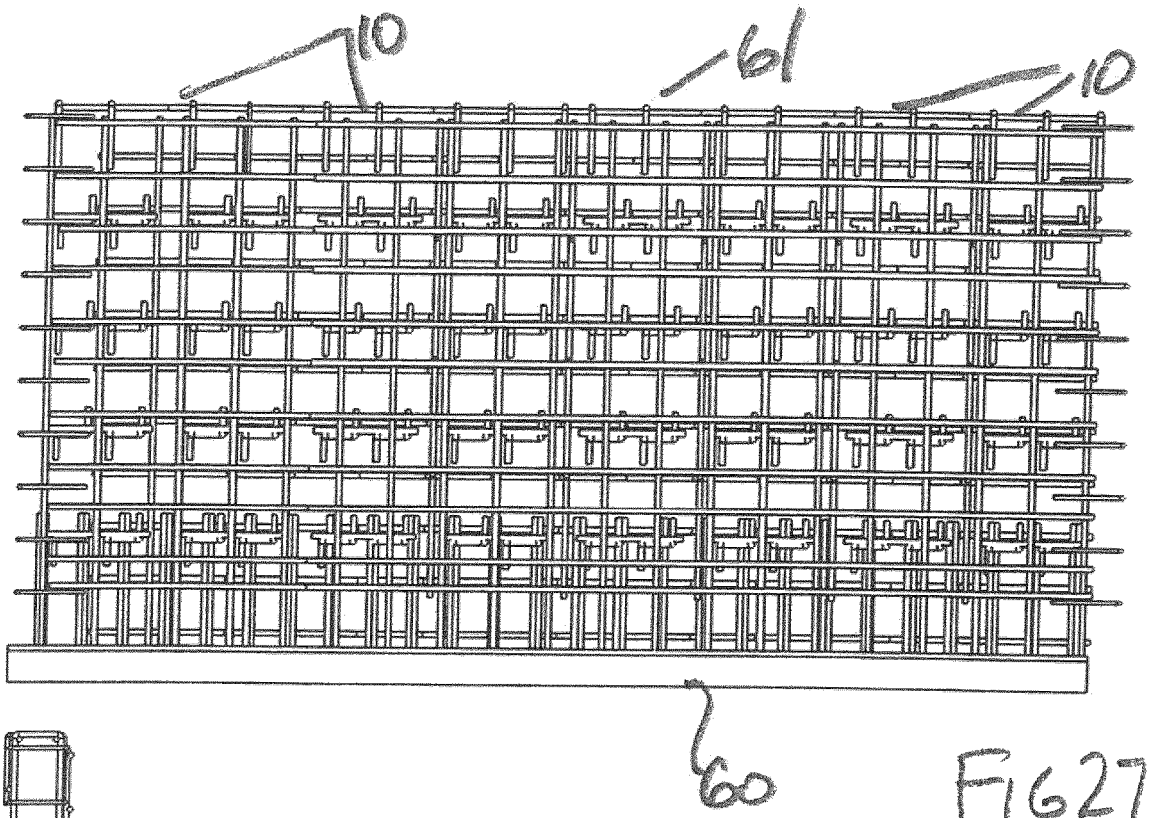
FIG. 27 is an elevational view of a panel assembly according to the method of the invention for forming reinforcement for a wall.
Figure 28:
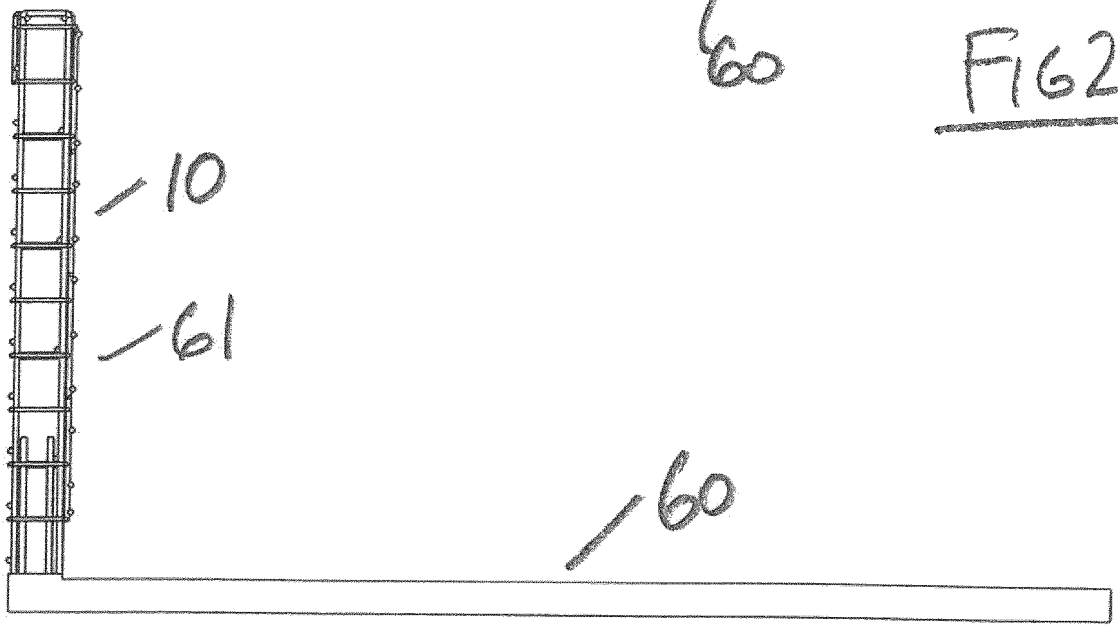
FIG. 28 is a side elevational view of the panel assembly shown in FIG. 27.
Figure 29:
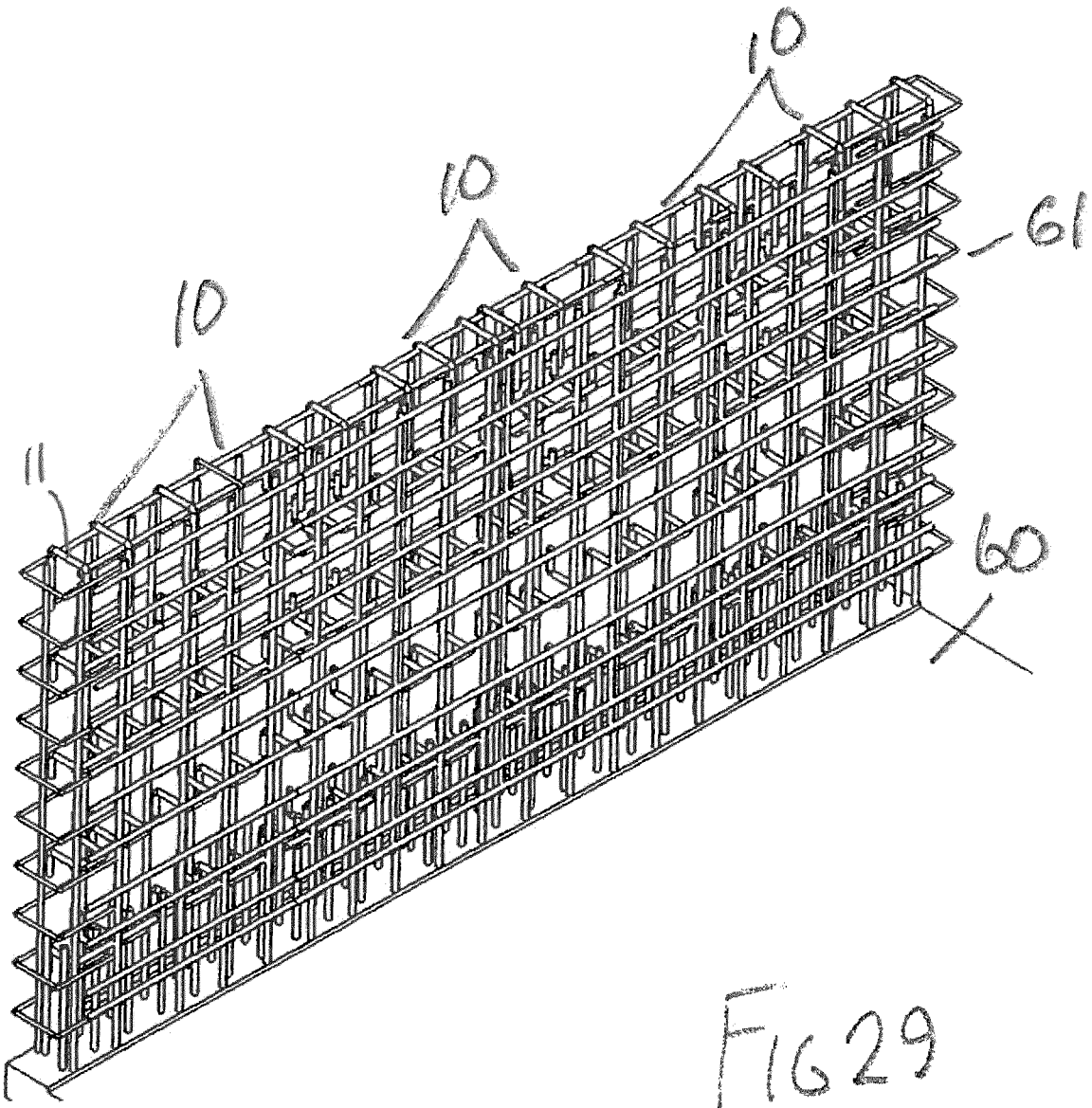
FIG. 29 is a perspective view of the panel assembly shown in FIG. 27.

FIG. 27 to FIG. 29 show a number of the preformed skeletal steel panels 10 arranged in an upright orientation on a building structure 60 to form a panel assembly 61 for reinforcement of a wall on the building structure 60.

Figure 31:
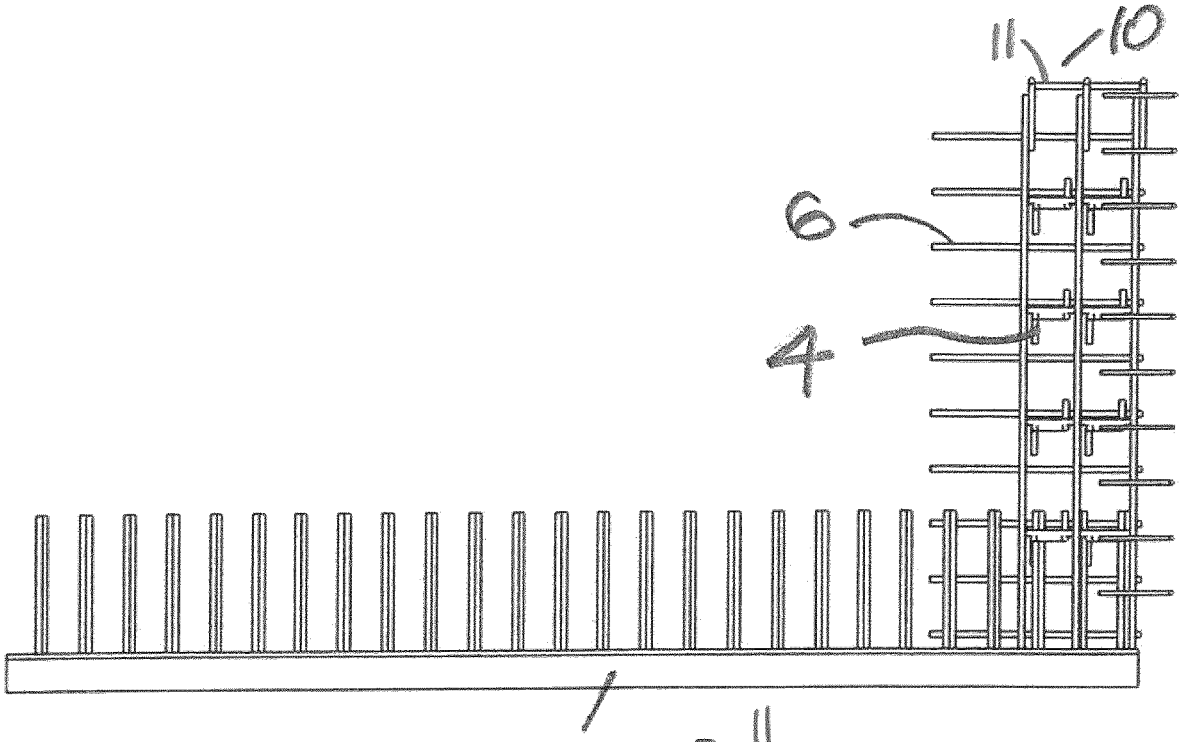
FIG. 31 is an elevational view of the arrangement shown in FIG. 30.
Figure 30:
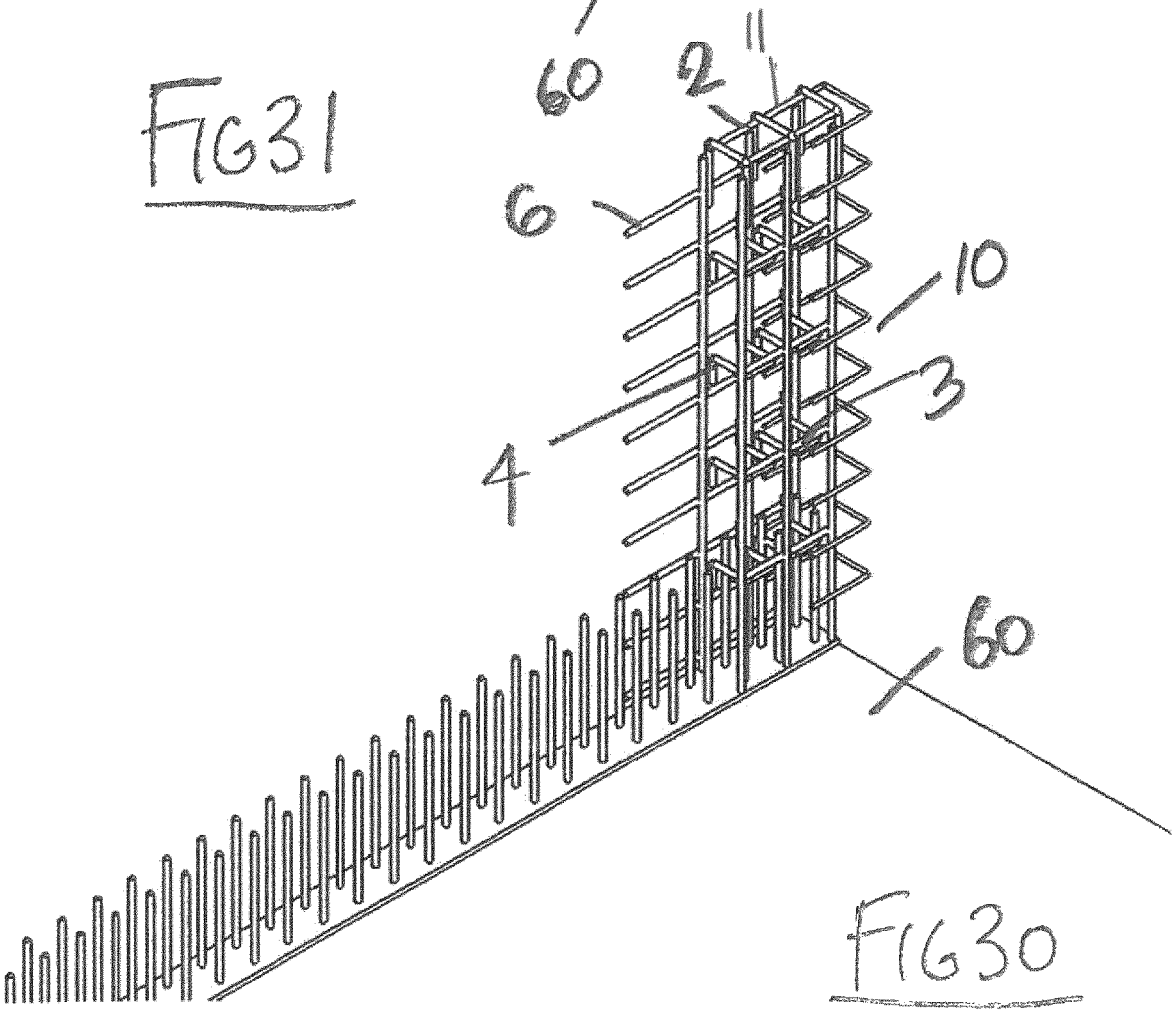
FIG. 30 is a perspective view showing placement of a first modular preformed skeletal steel panel in formation of the panel assembly shown in FIG. 27.
Figure 32:
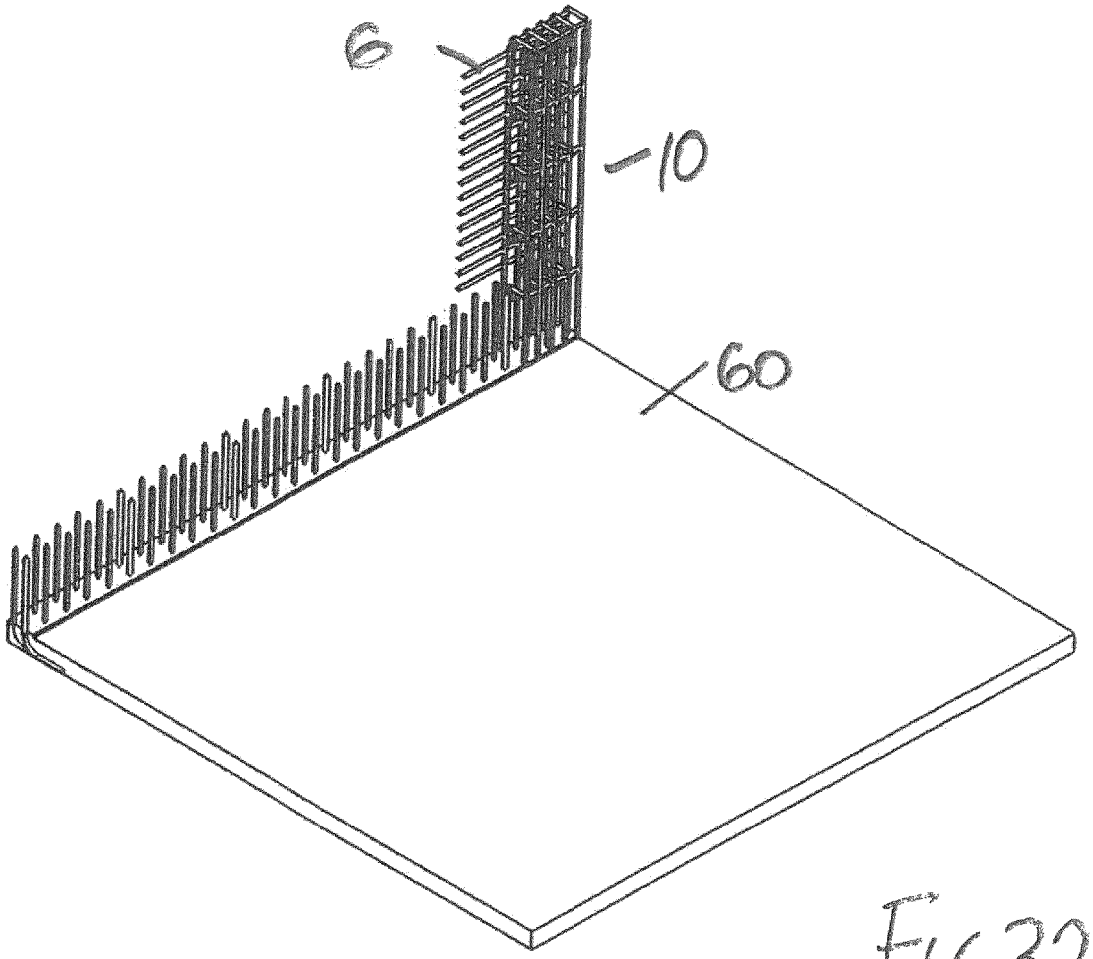
FIG. 32 is a perspective view of the arrangement shown in FIG. 30.

FIG. 30-FIG. 32 show mounting of the first panel 10 on the building structure 60 in forming the panel assembly 61.

Figure 33:
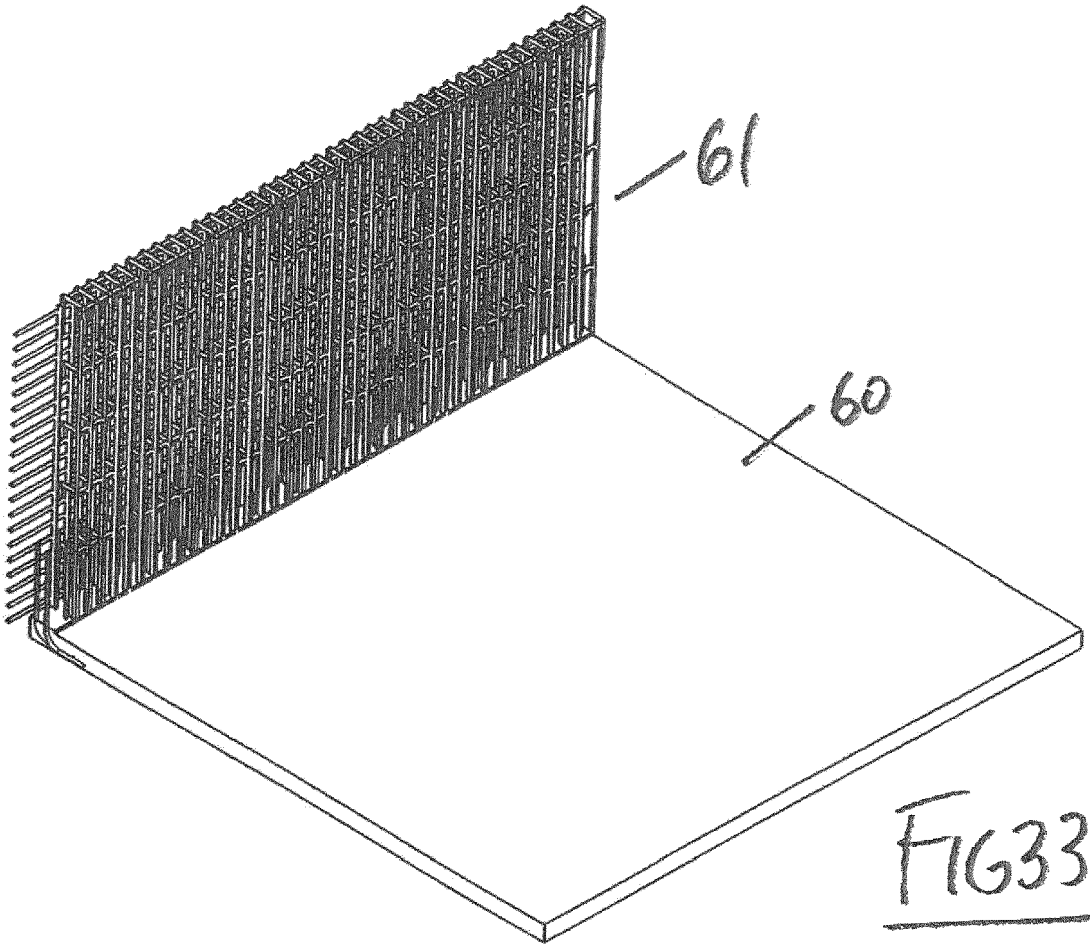
FIG. 33 is a perspective view of the assembled wall panel assembly.

FIG. 33 shows the composite panel assembly 61 on the building structure 60.

Figure 34:
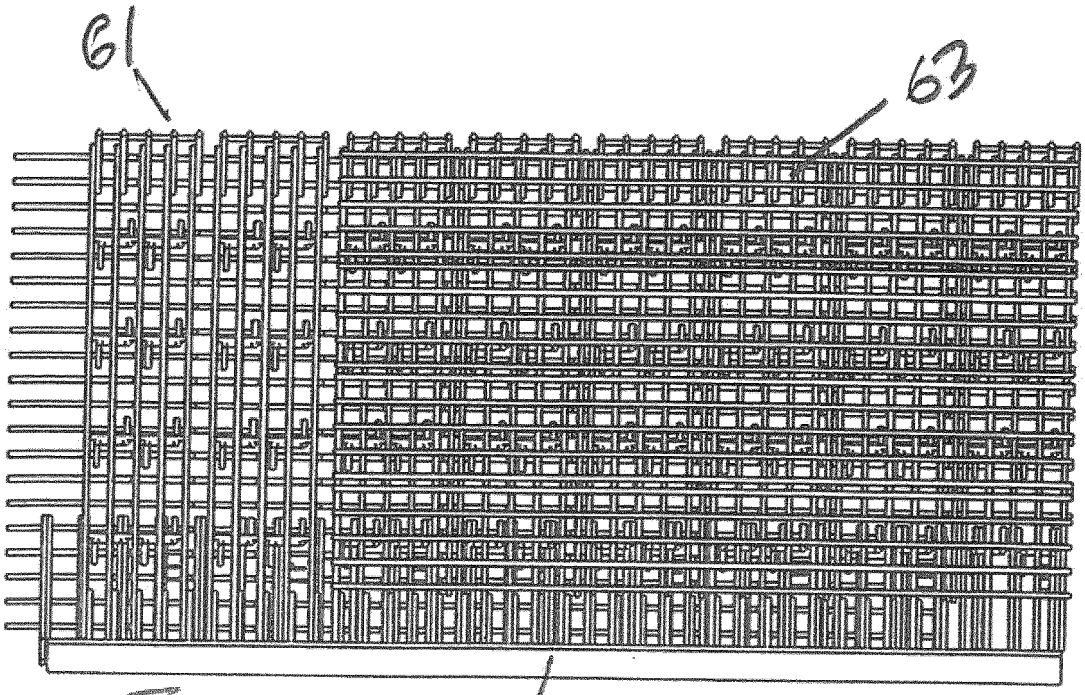
FIG. 34 is an elevational view of the wall panel assembly shown in FIG. 33.
Figure 35:
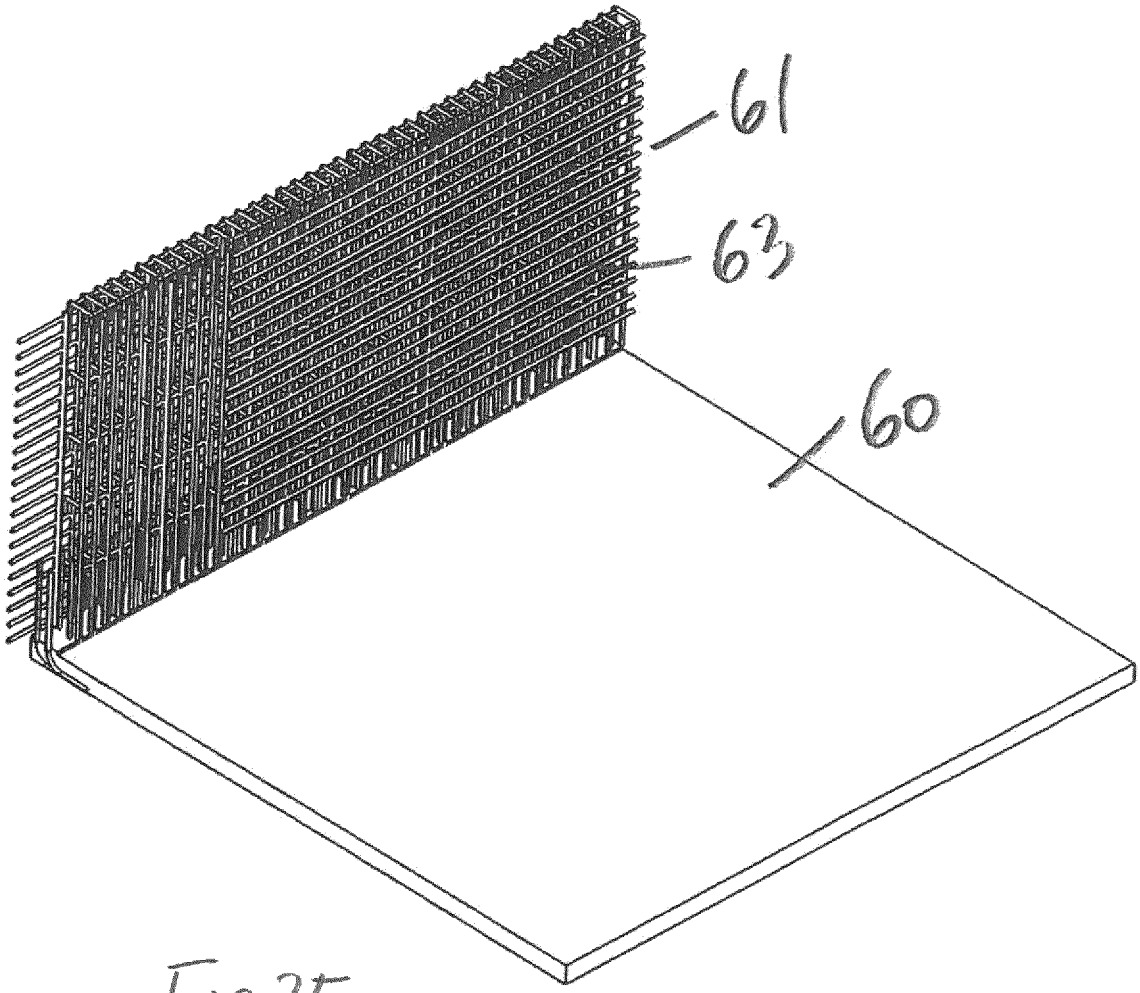
FIG. 35 is a perspective view of a composite reinforced steel skeletal framework including the wall panel assembly of FIG. 29 with an outer steel mesh mat covering an outer face of the panel assembly.

FIG. 34 and FIG. 35 show the placement of an outer steel mesh mat 63 against an outer face of the panel assembly 61 in accordance with the method of the invention.

Figure 36:
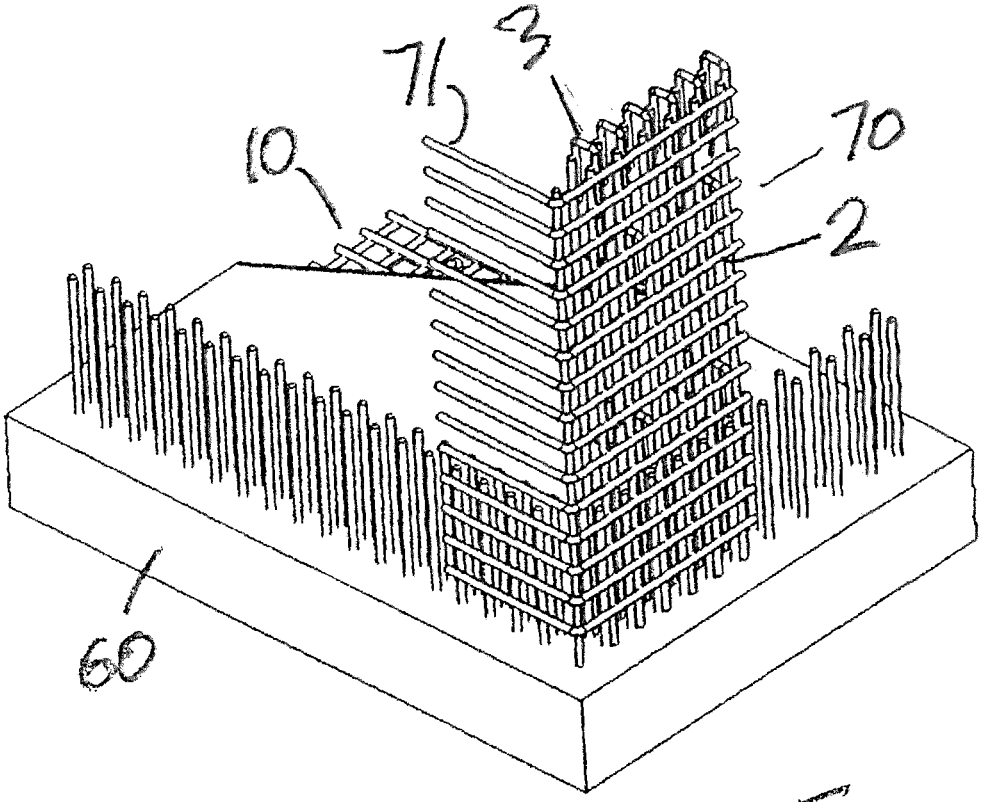
FIG. 36 is a detail perspective view showing a corner panel detail.

FIG. 36 shows a corner panel detail having a corner panel 70, similar to the panel 10 described previously, with splice bars 71 cranked at 90° to the outer layer 2 to automatically splice with a modular preformed skeletal steel panel 10 placed perpendicular to the panel 70.

Figure 38:
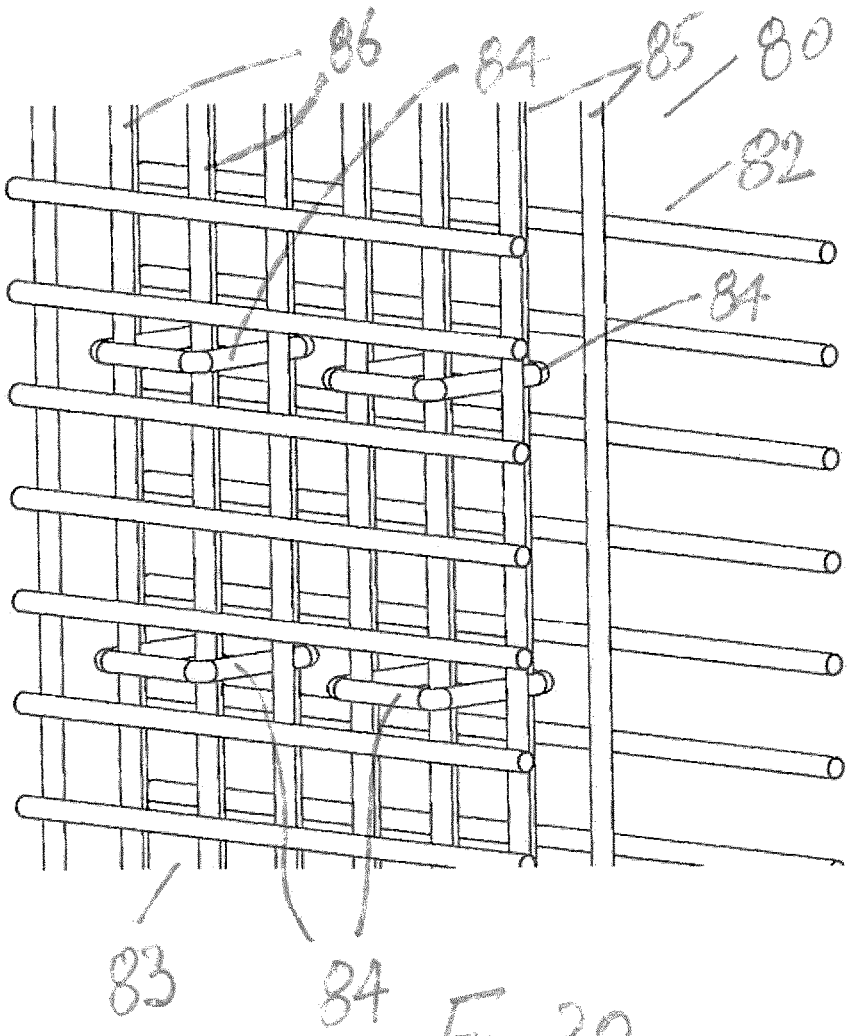
FIG. 38 is an enlarged detail perspective view of portion of the skeletal steel panel shown in FIG. 37.
Figure 37:
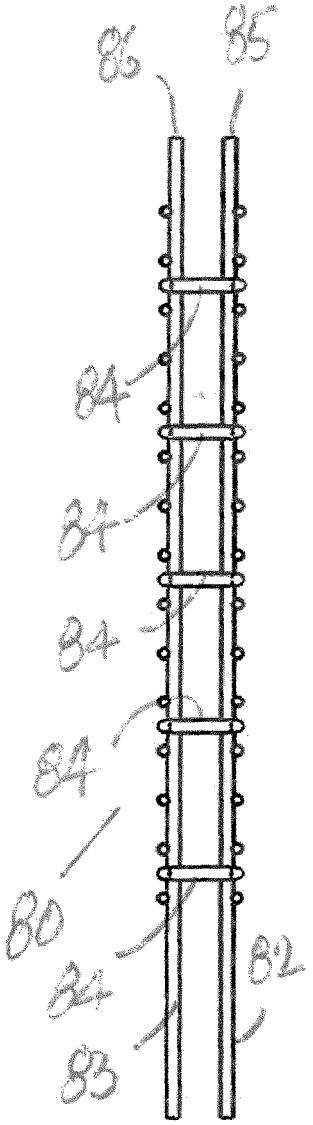
FIG. 37 is an elevational view of modular preformed skeletal steel panel according to the invention.
Figure 39:
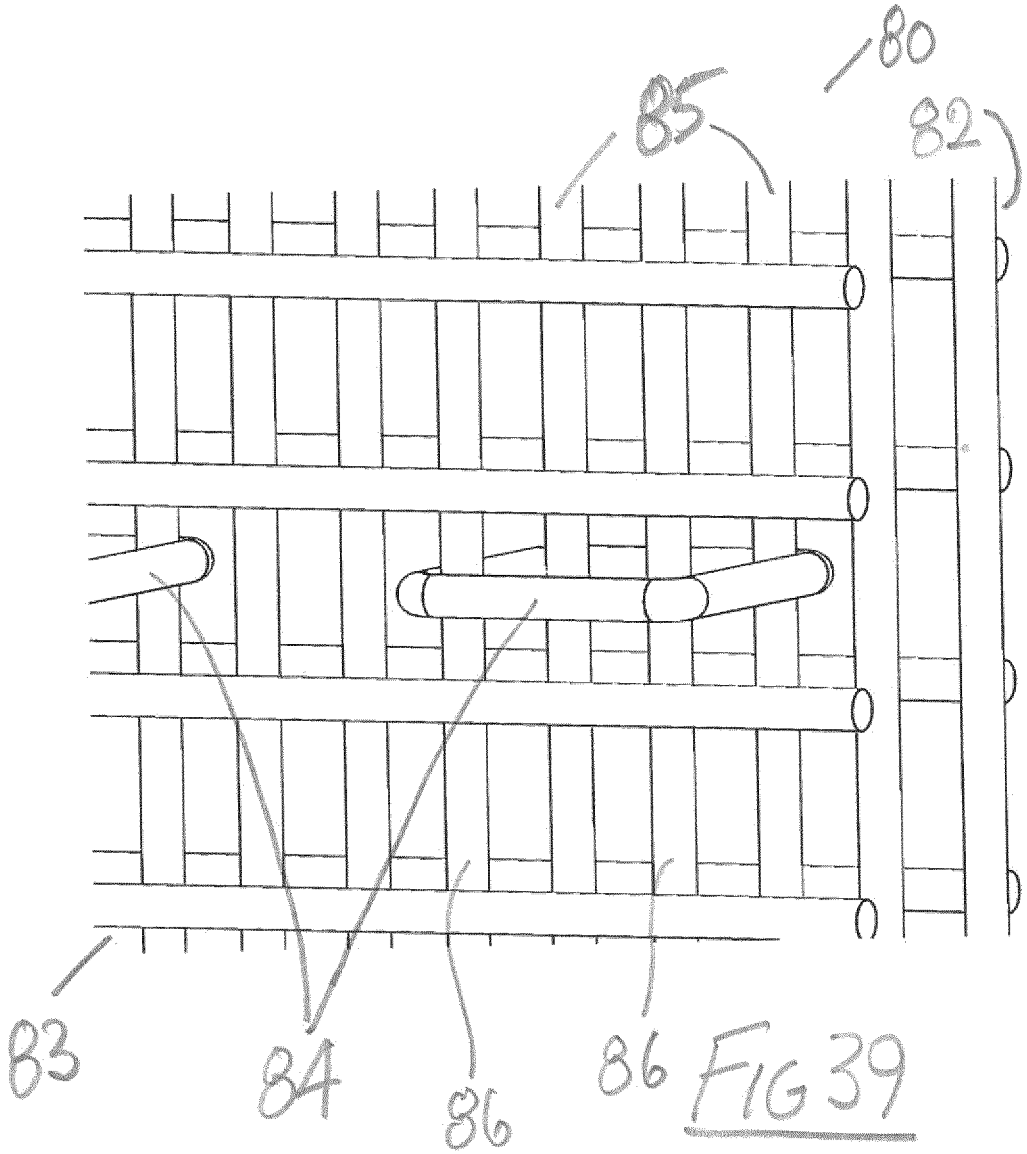
FIG. 39 is an enlarged detail perspective view showing portion of the skeletal steel panel of FIG. 37.

Referring to FIG. 37 and FIG. 38, there is shown a modular preformed skeletal steel wall panel 80 according to another embodiment of the invention. The modular skeletal steel wall panel 80 has an inner mesh layer 82 and an outer mesh layer 83 supported spaced-apart in parallel planes by intermediate spacers 84 extending between the layers 82, 83. In this case, the spacers 84 have a rectangular shape. It will be noted that inner bars 85, 86 of each mesh layer 82, 83 are secured inside the spacers 84. The spacer 84 and layers 82, 83 can be welded or steel wire tied together.

Figure 40:
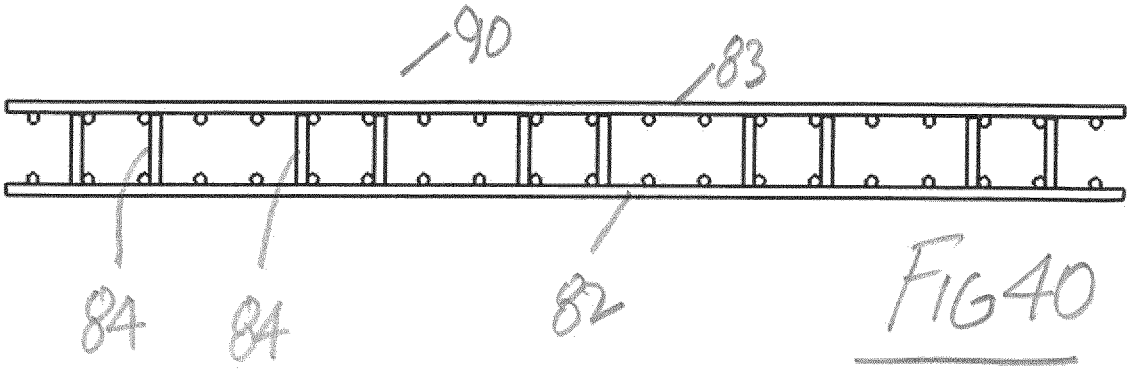
FIG. 40 is an elevational view of another modular preformed skeletal steel panel according to the invention.
Figure 41:
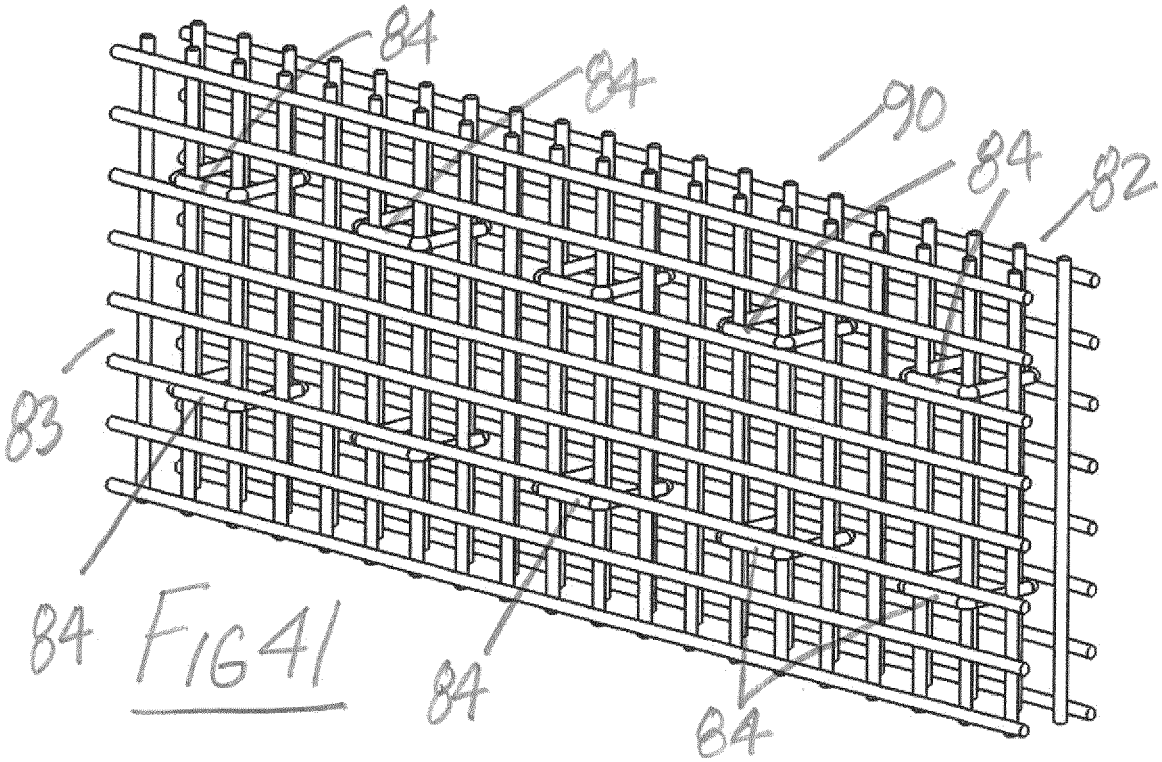
FIG. 41 is a perspective elevational view of the skeletal steel panel of FIG. 40.
Figure 42:
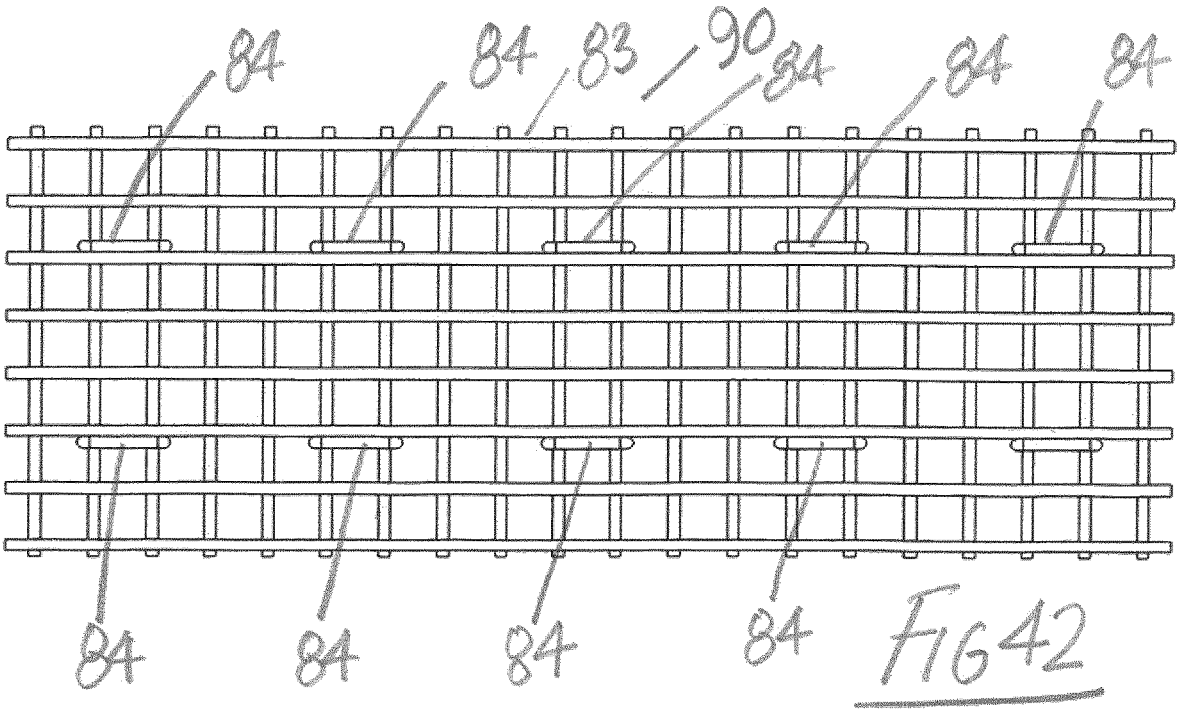
FIG. 42 is a plan view of the skeletal steel panel of FIG. 40.
Figure 43:
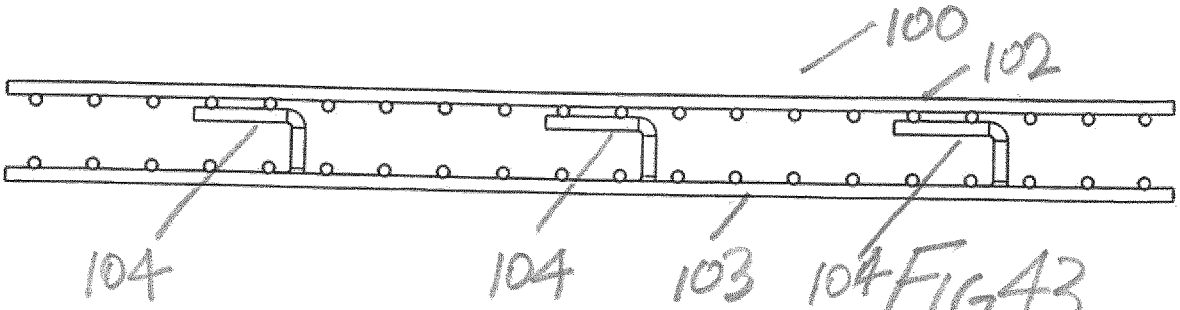
FIG. 43 is an elevational view showing another modular preformed skeletal steel panel of the invention
Figure 44:
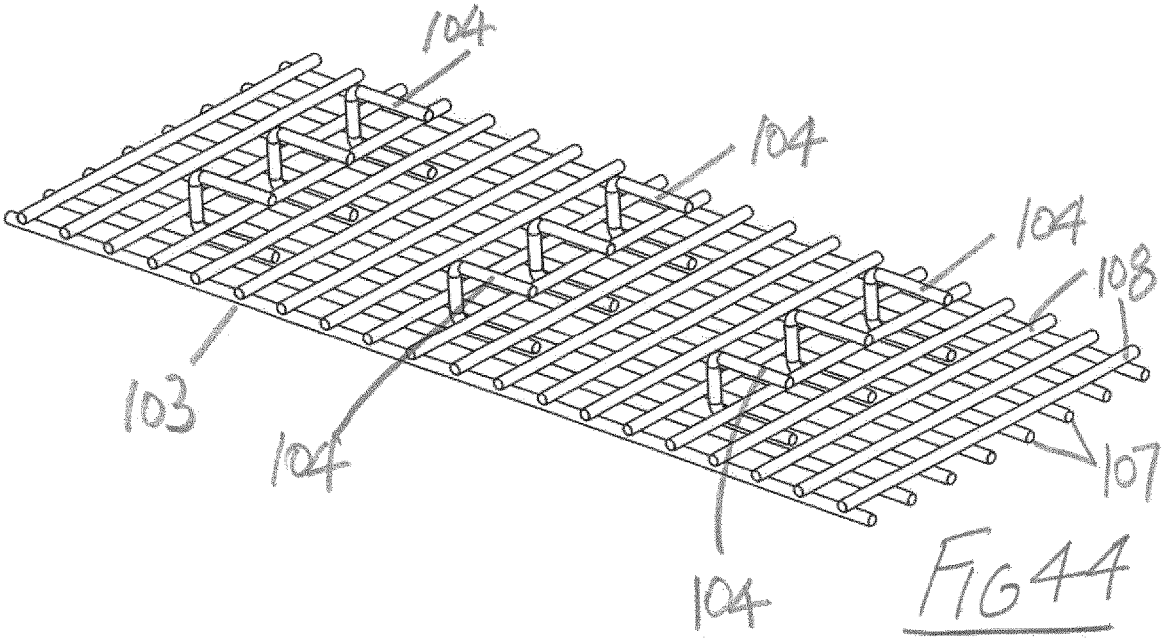
FIG. 44 is a detail perspective view of portion of the skeletal steel panel of FIG. 43, shown partially assembled.
Figure 45:
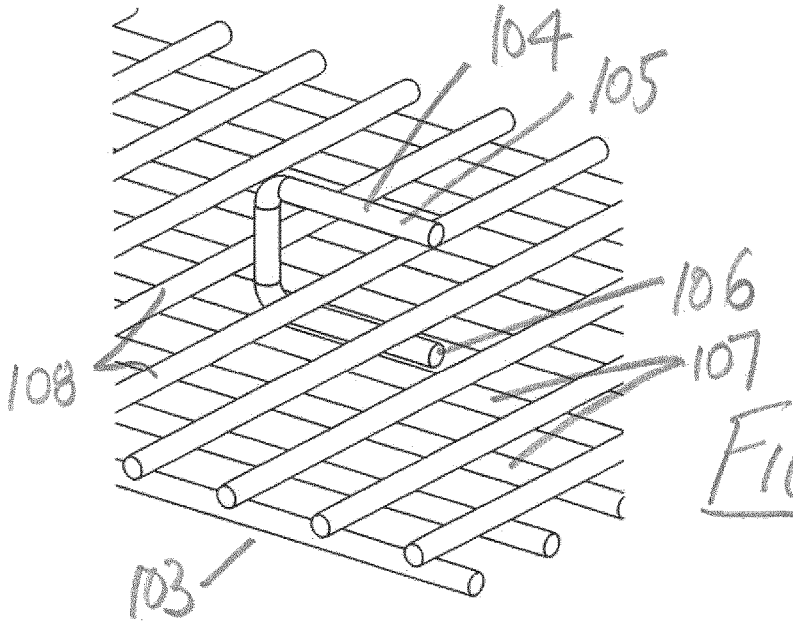
FIG. 45 is an enlarged detail perspective view of part of the skeletal steel panel portion shown in FIG. 44.
Figure 46:
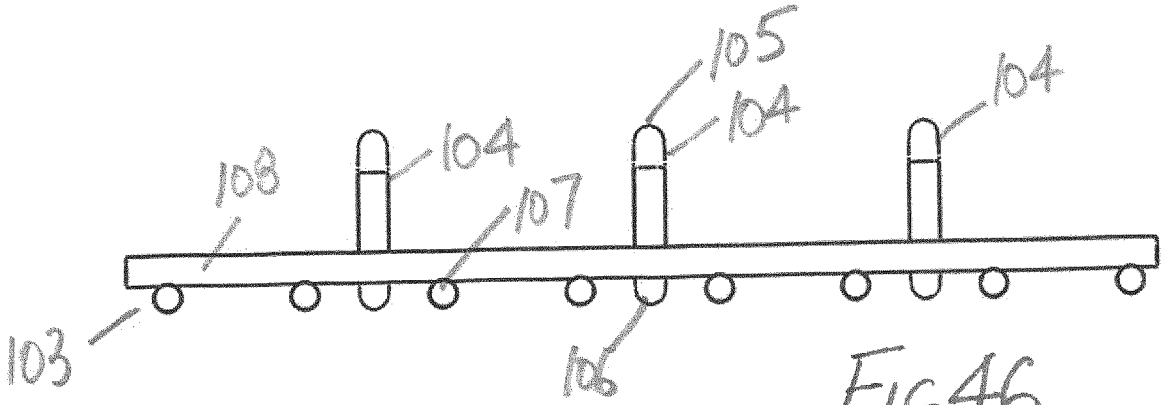
FIG. 46 is a detail end elevational view of the skeletal steel panel portion shown in FIG. 44.
Figure 47:
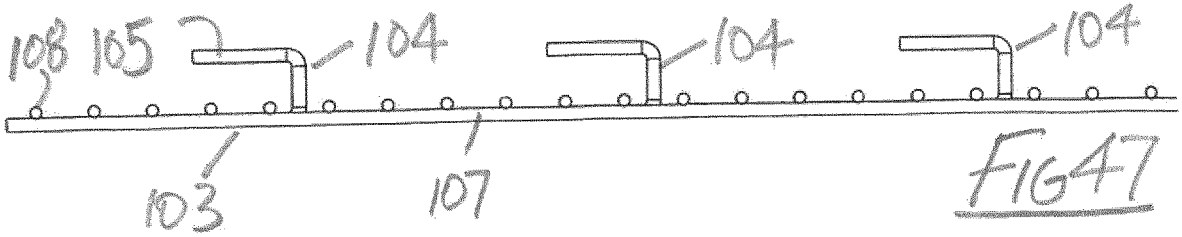
FIG. 47 is a side elevational view of the skeletal steel panel portion shown in FIG. 44.

Referring now to FIG. 40-FIG. 42, there is shown a modular preformed skeletal steel slab panel 90 which is largely similar to the modular preformed skeletal steel wall panel 80 described previously and like parts are assigned the same reference numerals. This shows another arrangement for securing two meshes 82, 83 apart as a prefabricated panel for reinforcing steel elements.

Referring now to FIG. 43-FIG. 47, there is illustrated another modular preformed skeletal steel panel 100 according to a further embodiment of the invention. In this case, the modular preformed skeletal steel panel 100 has an inner or upper mesh layer 102 and an outer or lower mesh layer 103 supported spaced-apart in parallel planes by intermediate spacers 104 extending between the layers 102, 103. In this case, the spacers 104 are U-shaped. Parallel spaced-apart arms 105, 106 of each spacer 104 can be aligned parallel with longitudinal bars 107 or transverse bars 108 of each mesh layer 102, 103.

Figure 48:
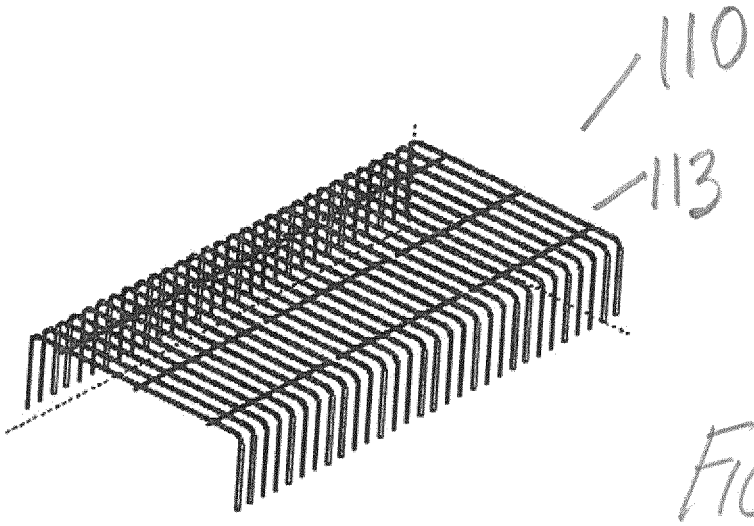
FIG. 48-FIG. 50 are perspective views showing an installation sequence of a prefabricated foundation pad.
Figure 49:
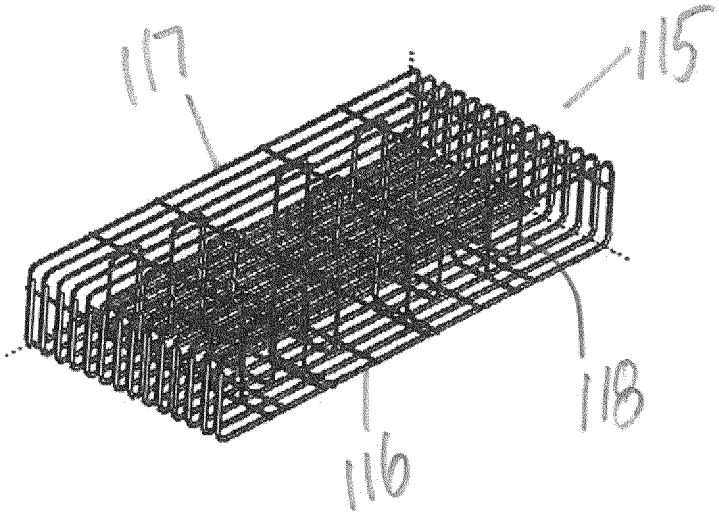
Figure 50:
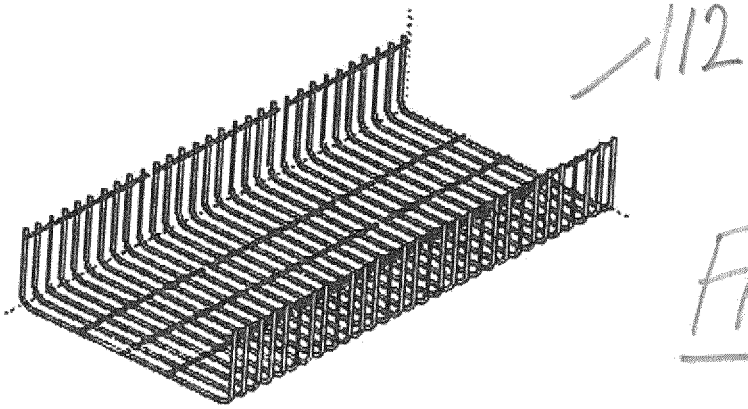

Referring now to FIG. 48-FIG. 50, there is shown an arrangement for the formation of foundation pads and bases which are placed under structural columns of a building or bridge or can be used to support ground beams. FIGS. 48-50 show an installation sequence of a prefabricated foundation pad 110. The pad 110 can be partially or fully prefabricated and installed/assembled on site. A bottom mesh 112 is bent into a U-shape to form a bottom layer of the pad 110. An intermediate panel 115 having a bottom layer 116 and a top layer 117 with spacers 118 in between the bottom layer 116 and the top layer 117 is placed inside/on top of the bottom mesh 112. A top mesh 113 bent into a U-shape is placed over the intermediate panel 115 to secure it in position and form the foundation pad 110.

Figure 51:
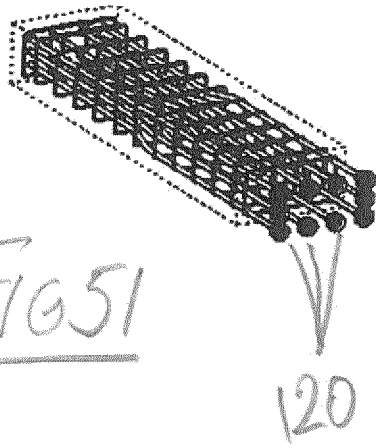
FIG. 51 is a perspective view of another preformed skeletal steel panel according to the invention.
Figure 52:
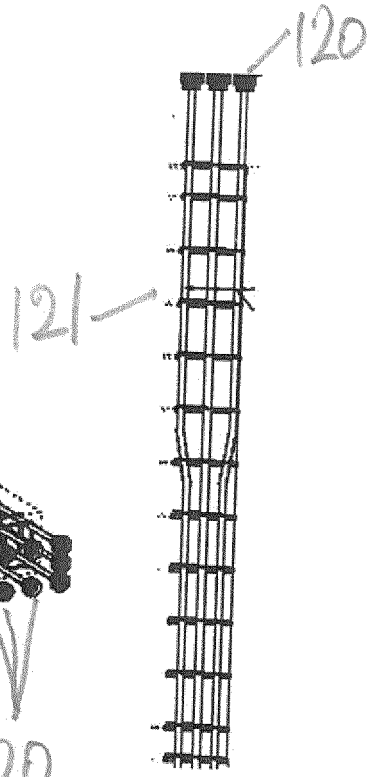
FIG. 52 is a side elevational view of the panel shown in FIG. 51.

Referring now to FIG. 51 and FIG. 52, there is shown a column shear head terminating detail. Terminating couplers 120 are used to provide dead end embedment for bars in concrete and remove the need for bent bars at the top of a column 121.

Additional steel can be used in prefabricated elements to increase structure strength and rigidity. This includes the use of Z-bars and additional links or spacers. Also additional welding may be provided in lifting point areas of the structure.

The method and panel system of the present invention have a number of advantages over the more conventional on-site assembly methods. Firstly, there is a significant time saving in the construction programme as the panels are fully assembly off-site and only need to be dropped into place in a row on the building structure immediately prior to pouring the concrete. It is also safer as there are no loose bar and all elements are prefabricated and designed to splice together with minimal effort. Trip hazards are eliminated as again the components are prefabricated and simply dropped into position and interlocked on site on the building structure.

The terms "comprise" and "include", and any variations thereof required for grammatical reasons, are to be considered as interchangeable and accorded the widest possible interpretation.

The invention is not limited to the embodiments hereinbefore described which may be varied in both construction and detail within the scope of the appended claims.

The invention claimed is:

1. A method for forming a composite reinforcing steel skeletal framework on a building structure, including:

placing a plurality of modular preformed skeletal steel panels side-by-side in a row on the building structure to form a panel assembly on the building structure, covering an outer face of the panel assembly with an outer steel mesh mat to form the composite reinforcing steel skeletal framework, each preformed skeletal steel panel comprising at least two mesh layers supported spaced-apart in parallel planes by intermediate spacers extending between the layers, each spacer comprising a cross member engaged with a first one of the layers, the cross member having outwardly extending legs at opposite ends of the cross member, each leg terminating in a foot which engages with a second one of the layers, the cross member, legs and feet being mutually perpendicular, wherein each preformed skeletal steel panel has a plurality of spaced-apart outwardly projecting splice bars for interengaging with an adjacent preformed skeletal steel panel in the panel assembly for interlocking the preformed skeletal steel panels in the panel assembly.

2. The method as claimed in claim 1, wherein the method includes mounting an inner steel mesh mat on the building structure and placing the skeletal steel panels on or against the inner steel mesh mat.

3. The method as claimed in claim 1, wherein the splice bars are located at an inner side of the preformed skeletal steel panel and the method includes mounting the outer steel mesh mat across outer sides of the preformed skeletal steel panels in the panel assembly at an opposite side to the splice bars.

4. The method as claimed in claim 1, wherein each steel mesh mat comprises a roll-out mat and the method includes rolling out the steel mesh mat across the panel assembly or across the building structure.

5. The method as claimed in claim 1, wherein the method includes arranging the panel assembly in a horizontal orientation on the building structure for forming a floor on the building structure.

6. The method as claimed in claim 1, wherein the method includes arranging the panel assembly in an upright orientation on the building structure for forming a wall on the building structure.

7. The method as claimed in claim 1, wherein each preformed skeletal steel panel has an adjustable side edge.

8. The method as claimed in claim 7, wherein the adjustable side edge is slidably adjustable on the preformed skeletal steel panel.

9. The method as claimed in claim 8, wherein the adjustable side edge comprises a U-frame having an outer end with a number of pairs of inwardly extending spaced-apart parallel arms which slidably engage with a main body of the preformed skeletal steel panel.

10. The method as claimed in claim 1, wherein the spacers comprise rectangular spacer elements.

11. The method as claimed in claim 1, wherein the spacers comprise V-shaped spacer elements.

12. A composite reinforcing steel skeletal framework comprising a plurality of modular preformed skeletal steel panels mounted side by side in a row to form a composite panel assembly, each preformed skeletal steel panel having a number of spaced-apart outwardly projecting splice bars engaged with an adjacent preformed skeletal steel panel, and an outer steel mesh mat mounted across an outer face of the panel assembly, each preformed skeletal steel panel comprising at least two mesh layers supported spaced-apart in parallel planes by intermediate spacers extending between the layers, each spacer comprising a cross member engaged with a first one of the layers, the cross member having outwardly extending legs at opposite ends of the cross member, each leg terminating in a foot which engages with a second one of the layers, the cross member, legs and feet being mutually perpendicular.

13. The composite reinforcing steel skeletal framework as claimed in claim 12, wherein the outer steel mesh mat is mounted across an outer face of the panel assembly at an opposite side to the splice bars.

* * * * *